US011186404B2

(12) United States Patent
McLeod

(10) Patent No.: US 11,186,404 B2
(45) Date of Patent: Nov. 30, 2021

(54) CONTAINERS WITH REMOVABLE DISPLAY CONVERTING PANELS

(71) Applicant: WestRock Shared Services, LLC, Atlanta, GA (US)

(72) Inventor: Michael B. McLeod, Romeoville, IL (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 16/502,460

(22) Filed: Jul. 3, 2019

(65) Prior Publication Data

US 2021/0002021 A1 Jan. 7, 2021

(51) Int. Cl.
*B65D 5/42* (2006.01)
*B65D 43/02* (2006.01)
*B65D 5/22* (2006.01)

(52) U.S. Cl.
CPC ..... *B65D 5/4266* (2013.01); *B65D 5/22* (2013.01); *B65D 43/0202* (2013.01)

(58) Field of Classification Search
CPC .... B65D 5/4266; B65D 5/22; B65D 43/0202; B65D 5/542; B65D 5/5445; B65D 5/445; B65D 5/54; B65D 5/16; B65D 5/545; B65D 2571/00574; B65D 5/0281; B65D 5/441
USPC ..... 229/200, 242, 240, 235, 103, 122, 229/122.32, 919, 199; 206/736, 772, 774
See application file for complete search history.

(56) References Cited

U.S. PATENT DOCUMENTS 4,000,811 A * 1/1977 Hardison ..... B65D 5/48048 229/242
4,191,288 A * 3/1980 Hostad ..... B65D 5/5206 206/764
4,471,870 A * 9/1984 Uhlig ..... B65D 71/38 206/150
4,592,914 A * 6/1986 Kuchenbecker ... B65D 81/3453 219/729
5,651,497 A * 7/1997 Ventura ..... B65D 5/5415 229/235
5,957,294 A * 9/1999 Kanter ..... B65D 5/5405 206/774
6,129,211 A * 10/2000 Prakken ..... B65D 5/5253 206/526
9,145,228 B2 9/2015 Bevier
9,611,066 B2 4/2017 Bevier
2010/0282831 A1* 11/2010 Fithian ..... B65D 5/321 229/238
2012/0160735 A1* 6/2012 Waidelich ..... B65D 5/52 206/736

* cited by examiner

*Primary Examiner* — Christopher R Demeree
(74) *Attorney, Agent, or Firm* — Neil G. Cohen

(57) ABSTRACT

A container includes a plurality of panels connected together to enclose an interior space. At least one tear away portion is defined in the plurality of panels. An insert is adhered to the at least one tear away portion for removal from the plurality of panels together with the at least one tear away portion to provide access to the interior space. The insert can extend from a first end of the interior space to an opposite end of the interior space as a load bearing member between two opposed panels of the plurality of panels.

15 Claims, 24 Drawing Sheets

Fig. 6
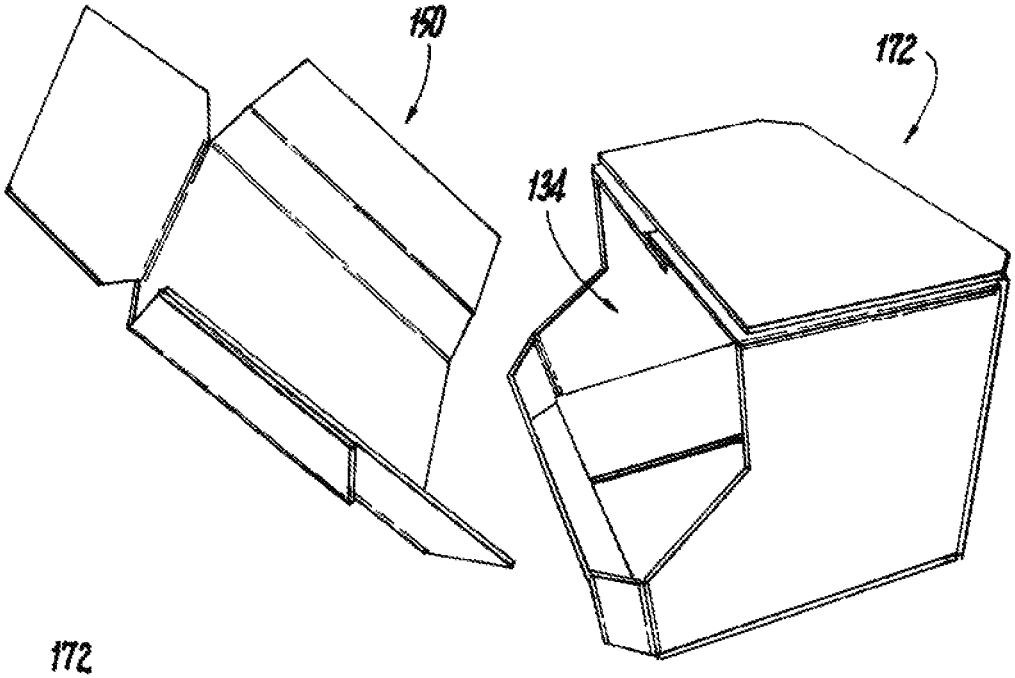
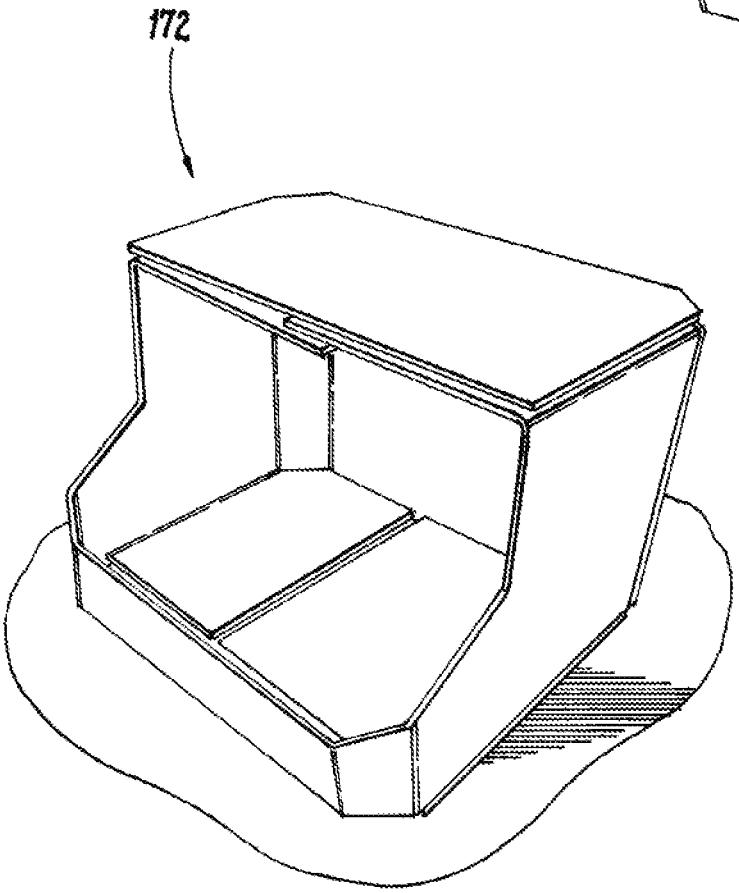
Fig. 7

Fig. 11
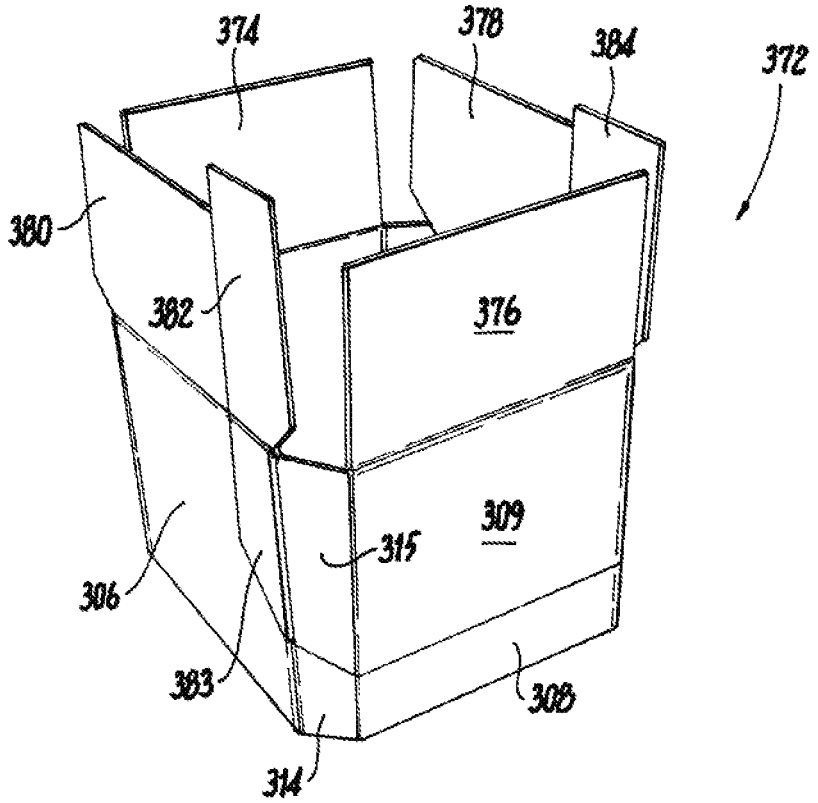
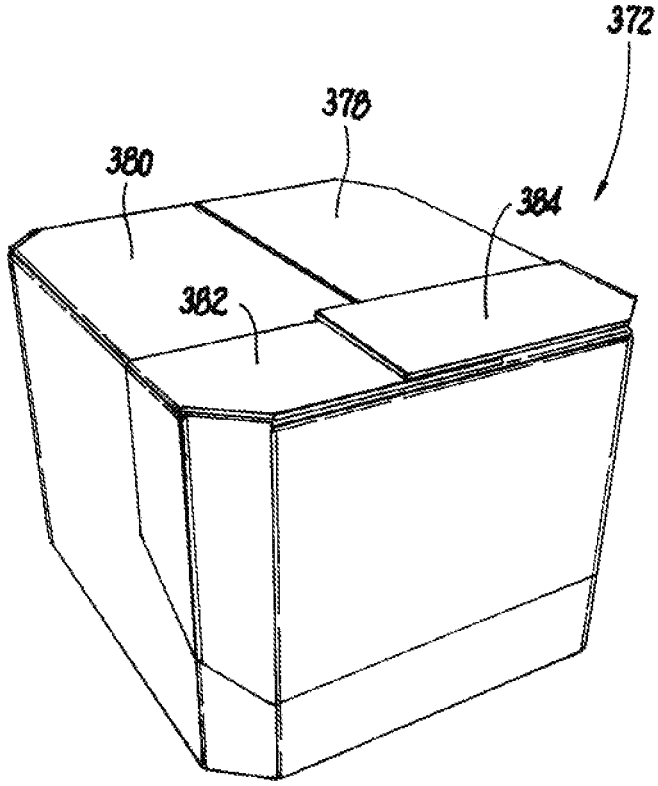
Fig. 12

Fig. 21
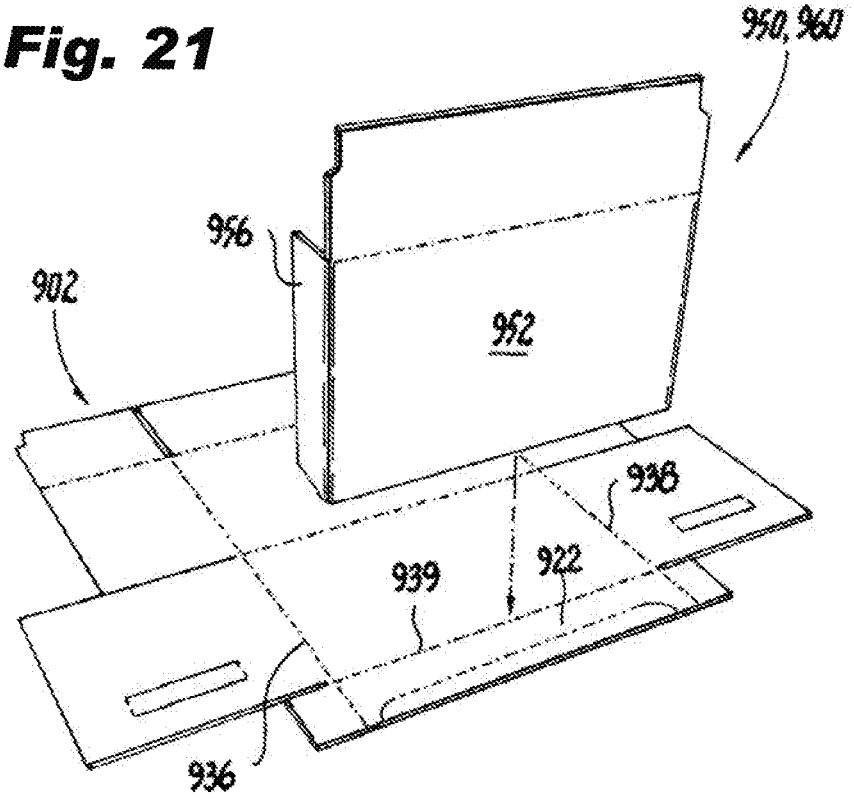
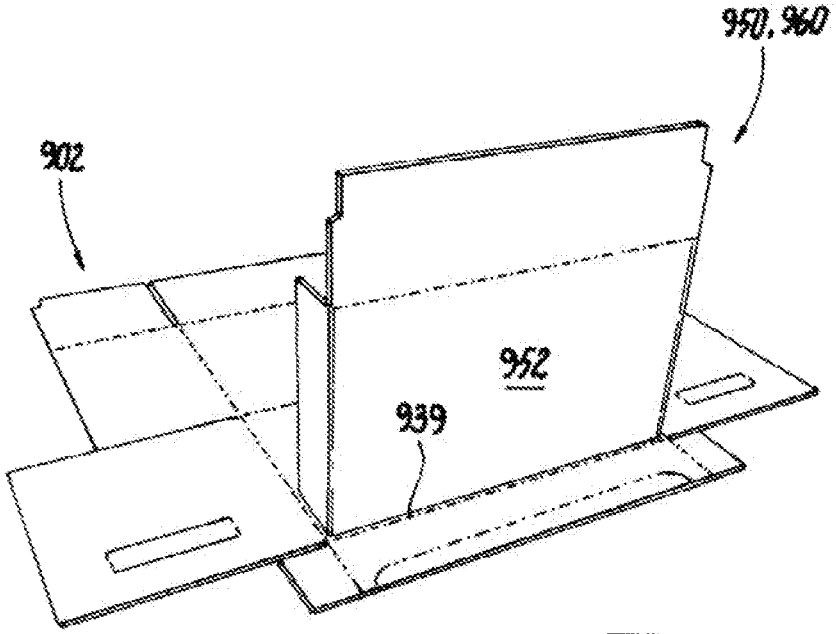
Fig. 22

CONTAINERS WITH REMOVABLE DISPLAY CONVERTING PANELS

BACKGROUND OF THE INVENTION

1. Field of the Invention

The present disclosure relates to containers, and more particularly to containers with removable panels for displaying product, e.g., in a retail setting.

2. Description of Related Art

Conventional retail ready display containers can be used to ship product to a retail location. Once in the retail setting, the containers can be converted, e.g., by removing a panel from the container along a perforation line. Once the panel is removed, the product within the container is displayed and customers can access and remove product directly from the container.

The conventional techniques have been considered satisfactory for their intended purpose. However, there is an ever present need for improved containers. This disclosure provides a solution for this need.

SUMMARY OF THE INVENTION

A container includes a plurality of panels connected together to enclose an interior space. At least one tear away portion is defined in the plurality of panels. An insert is adhered to the at least one tear away portion for removal from the plurality of panels together with the at least one tear away portion to provide access to the interior space.

The insert can extend from a first end of the interior space to an opposite end of the interior space as a load bearing member between two opposed panels of the plurality of panels. The insert can define a load bearing path from the first end of the interior space to the second end of the interior space, wherein the load bearing path is free of lines of weakness. The insert can include corrugated paper material with corrugations aligned along a corrugation direction, wherein the load bearing path extends in the corrugation direction.

The insert can be positioned inside the interior space. It is also contemplated that the insert can form at least part of an exterior cooperating with the plurality of panels to enclose the interior space.

The at least one tear away portion can be defined in the plurality of panels by at least one respective line of weakness in the plurality of panels. The at least one tear away portion can include a first tear away portion defined in a first side panel of the plurality of panels, and a second tear away portion defined in a second side panel of the plurality of panels opposite the first side panel, wherein the insert is adhered to the first and second tear away portions.

The insert can include a main insert panel, a first side flap connected to the main insert panel along a first fold line, and a second side flap connected to the main insert panel along a second fold line opposite the first fold line. The insert can include a top flap connected to the main insert panel along a top fold line extending in a direction from the first fold line to the second fold line.

The at least one tear away portion can include an opposed pair of tear away portions each defining a full perimeter in one of two opposed side panels of the plurality of panels so removal of the insert leaves a window in each of the two opposed side panels. The at least one tear away portion can include a front tear away portion in front tray panel of the plurality of panels.

A blank system for forming a container includes a main blank including a plurality of panels foldably connected together for enclosing an interior space. At least one tear away portion is defined in the plurality of panels. An insert blank is included which is configured to form an insert adhered to the at least one tear away portion for removal from the plurality of panels together with the at least one tear away portion to provide access to the interior space. The main blank and the insert blank can be adhered together.

A method of converting a container for retail includes removing an insert from a container to display product within the container. Removing the insert includes removing at least a tear away portion of a plurality of panels from the plurality of panels of the container, wherein the insert and tear away portion are adhered together for removal as one piece.

A method of forming a container from a main blank and an insert blank includes adhering the insert blank to the main blank to create a combined blank and wrapping the panels of the combined blank around an area to be enclosed by the container. The folds occur at respective fold lines between panels of the combined blank. A first set of opposed panels is attached to a first end of the wrapped combined blank is folded to enclose one end of the container, and a second set of opposed panels attached to a second end of the wrapped combined blank is folded to enclose the container. A product may be added to the container before the second set of opposed panels is folded to enclose the container. The insert blank may be adhered only to one or more portions of the main blank that are removable portions as defined by a perforated line.

A separate method of forming a container from a main blank and an insert blank includes applying adhesive to one or more interior portions of the main blank that contact the insert blank, and folding a pair of side panels of the insert blank 90 degrees to align with the fold lines of the main blank. The insert blank is aligned orthogonal to the main blank which defines a single plane. The panels of the main blank are sequentially folded out of the single plane to form the container. The insert blank forms one of the four walls of the container and the panels of the main blank form the other three walls of the container. Panels of the insert blank and main blank are folded together to enclose the top of the container. A product may be added to the container before the panels of the insert blank and main blank are folded together to enclose the container. The insert blank may be adhered only to one or more portions of the main blank that are removable portions as defined by a perforated line.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein:

FIGS. 3-7 are perspective views of the container of FIG. 2, showing stages of converting the container for retail display;

FIGS. 11-13 are perspective views of a container constructed from the blank system of FIG. 10, showing the container open and ready to receive product, showing the container closed, and showing the container converted for retail display, respectively;

FIGS. 21-25 are perspective views of a container constructed from the blank system of FIG. 20, showing stages of erecting the container;

DETAILED DESCRIPTION OF THE PREFERRED EMBODIMENTS

Figure 1:
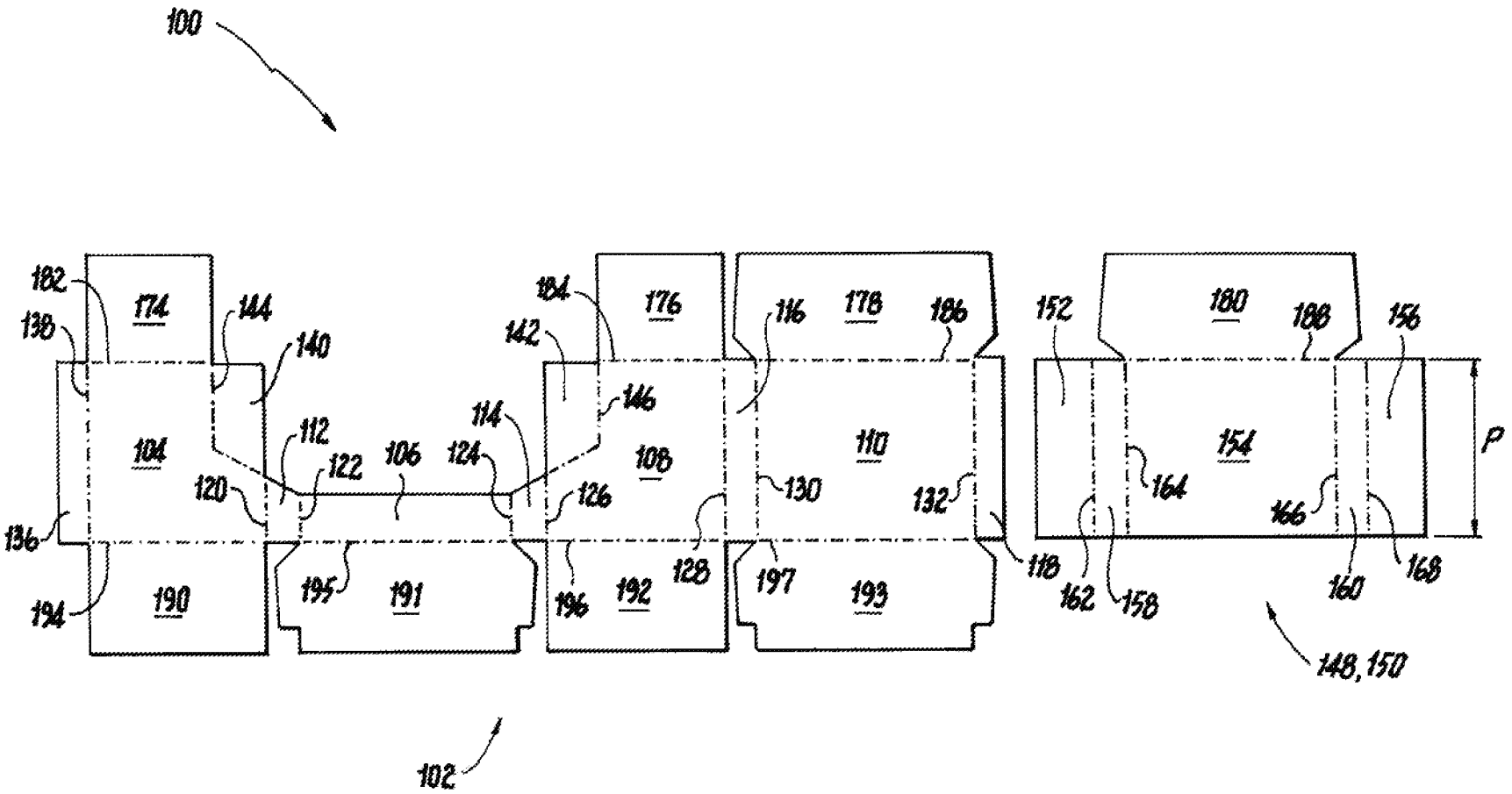
FIG. 1 is a plan view of an embodiment of a blank system constructed in accordance with the present disclosure, showing the main blank and the insert blank.

Reference will now be made to the drawings wherein like reference numerals identify similar structural features or aspects of the subject disclosure. For purposes of explanation and illustration, and not limitation, a partial view of an embodiment of a blank system for forming a container in accordance with the disclosure is shown in FIG. 1 and is designated generally by reference character 100. Other embodiments of containers in accordance with the disclosure, or aspects thereof, are provided in FIGS. 2-30, as will be described. The systems and methods described herein can be used to provide load bearing support in retail ready convertible containers.

Figure 2:
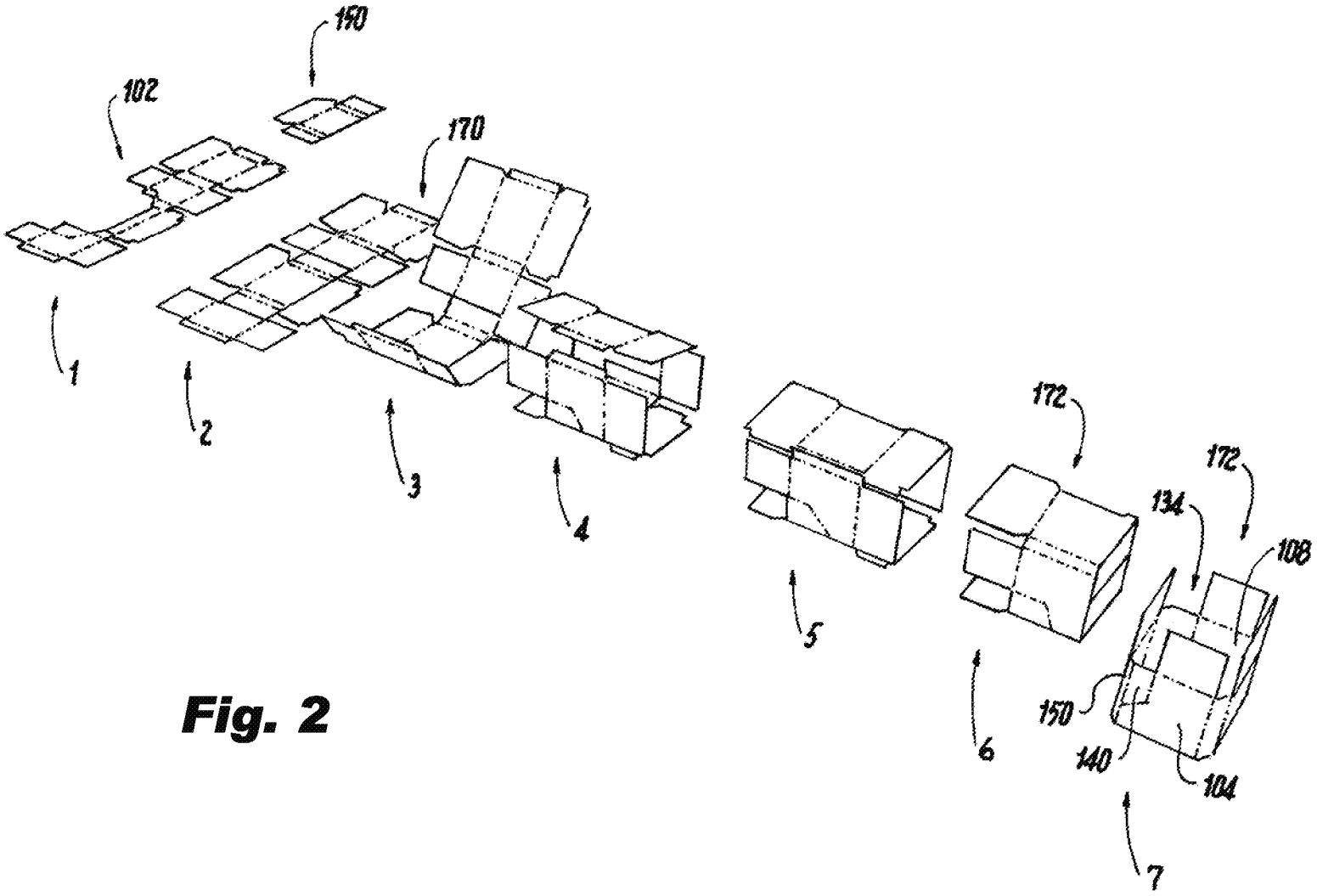
FIG. 2 is a schematic view of the blank system of FIG. 1, showing stages of erecting the blanks into a container.

The blank system 100 includes a main blank 102 including a plurality of panels 104, 106, 108, 110 foldably connected together by respective corner panels 112, 114, 116, 118 along the fold lines 120, 122, 124, 126, 128, 130, 132 for enclosing an interior space 134 (not shown in FIG. 1, but see FIG. 2). An adhesive flap 136 is foldable connected to panel 104 along fold line 138. Panels 104 and 108 each include a respective tear away portion 140, 142. Each of the tear away portions 140, 142 is defined in the respective panel 104, 108 by a respective line of weakness 144, 146 defined in the respective of panel 104, 108. The lines of weakness 144, 146 can be formed in any suitable manner, such as scoring, perforating, crushing, or the like. The first tear away portion 140 is defined in a first side panel 104, and the second tear away portion 142 is defined in the second side panel 108, which when erected is on the opposite side of the internal space 134 from the first side panel 104 as shown in FIG. 2.

An insert blank 148 is included which is configured to form an insert 150. The insert blank 148 includes panels 152, 154, 156 connected together by corner panels 158, 160 along the fold lines 162, 164, 166, 168. As indicated in FIG. 2, the main blank 102 and the insert blank 148 (shown at stage 1 in FIG. 2) can be adhered together to form a complete blank 170 (shown at stage 2 in FIG. 2) for forming a container 172 (shown at stages 6 and 7 in FIG. 2). The panels 152 and 156 of the insert 150 are adhered to the first and second tear away portions 140, 142, respectively as indicate in stages 1 and 2 of FIG. 2. This allows for later removal of the insert 150 from the plurality of panels 104, 106, 108, 110 together with the tear away portions 140, 142 to provide access to the interior space 134.

With reference again to FIG. 1, the main blank 102 includes top panels 174, 176, 178. The insert blank 148 includes a top panel 180. The top panels 174, 176, 178, 180 are connected to their respective panels 104, 106, 108, 110 along respective top fold lines 182, 184, 186, 188. The top flap 180 is connected to the main insert panel 154 along a top fold line 188 extending in a direction from the first fold line 164 to the second fold line 166. The main blank 102 includes bottom flaps 190, 191, 192, 193 connected to respective panels 104, 106, 108, 110 along respective fold lines 194, 195, 196, 197. The blank system 100 can be manufactured at a first location, and can be shipped in palletized form either together or separately to a separate location, where the main blank 102 and the insert blank 148 are adhered together, erected, and filled with product. It is also contemplated that the blank system 100 can be adhered together at the first location and shipped in palletized form to the second location for being erected and filled with product.

Figure 3:
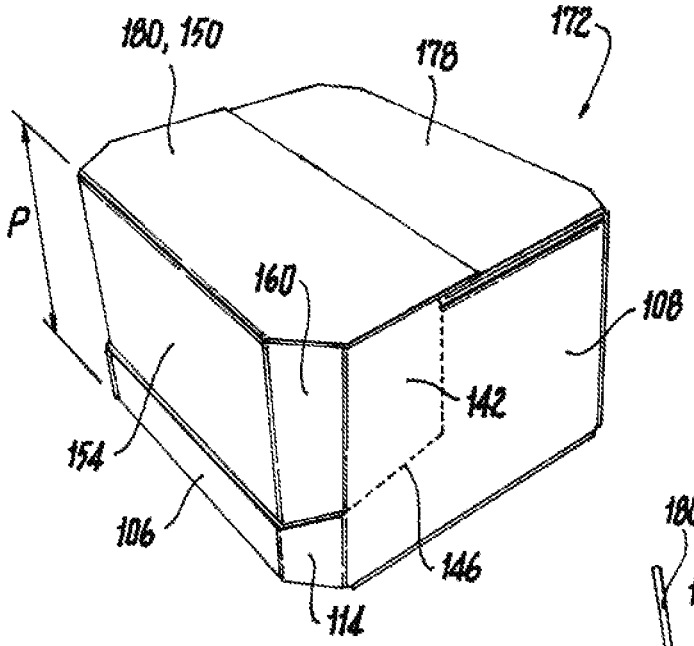

With reference now to FIG. 2 (noting that not all of the reference characters in this paragraph are found in FIG. 2 for sake of clarity, but see FIG. 1), the container 172 includes a plurality of panels 104, 106, 108, 110 connected together to enclose an interior space 134. In stage 1, the insert 150 is adhered to the tear away portions 140, 142 to form the full blank 170 shown for stage 2. The top flap 180 becomes the fourth top flap for the full blank 170. The full blank 170 is folded along the fold lines 138, 120, 122, 124, 126, 128, 130, 132, 162, 164, 166, and 168 as indicated in stages 3 and 4 of FIG. 2 to wrap the panels 104, 106, 108, 110, and 154 around the interior space 134. The corner flap 118 and adhesive flap 136 are adhered together as shown at stage 5 in FIG. 2. The bottom flaps 190, 191, 192, 193 are folded along their respective fold lines 194, 195, 196, 197 to overlap one another and are adhered in place as shown in stage 6 of FIG. 2. In the position shown in stage 7 of FIG. 2, product can be placed into the interior space 134 of the container 172, and then the top flaps 174, 176, 178, 180 can be folded along their respective fold lines 182, 184, 186, 188 to overlap one another and to be adhered, taped, or otherwise secured in place to close the container 172 as shown in FIG. 3. The footprint of the container 172, as oriented in FIG. 3, is octagonal, with the corner panels, e.g., 112/158, 114/160, 116, 118, respectively, forming four edges of the octagon, and the panels 140, 106, 108, 110 forming the remaining four edges of the octagon. After the container 172 is filled, it can be shipped from the second location to a retail location, where it can be converted for retail use as described below.

With continued reference to FIG. 3, the insert 150 extends from a first end, e.g., the bottom end as oriented in FIG. 3, of the interior space 134 (identified in FIG. 2) to an opposite end, e.g., the top end as oriented in FIG. 3, of the interior space 134 as a load bearing member. The insert 150 is a load bearing member between two opposed panels of the plurality of panels, i.e., between the closed bottom panel formed by the bottom flaps 190, 191, 192, 193 and the closed top panel formed by top flaps 174, 176, 178, 180. The insert 150 defines a load bearing path P (identified in FIGS. 1 and 3) from the first end of the interior space 134 to the second end of the interior space 134. The load bearing path P is free of lines of weakness such as scores, perforations, crush lines, or the like. The insert 150 can include corrugated paper material with the corrugations aligned along a corrugation direction parallel to the load bearing path P. Thus even though the lines of weakness 144 and 146 (identified in FIG. 1) are provided for conversion of the container 172, the load path P through the insert 150 is not weakened. This allows for filled containers 172 to be stacked under more weight before crush damage occurs than if insert 150 were not included. For example, if multiple containers 172 are stacked during shipping, there is less risk of the bottom containers 172 in the stack being crushed due to the insert 150.

Figure 4:
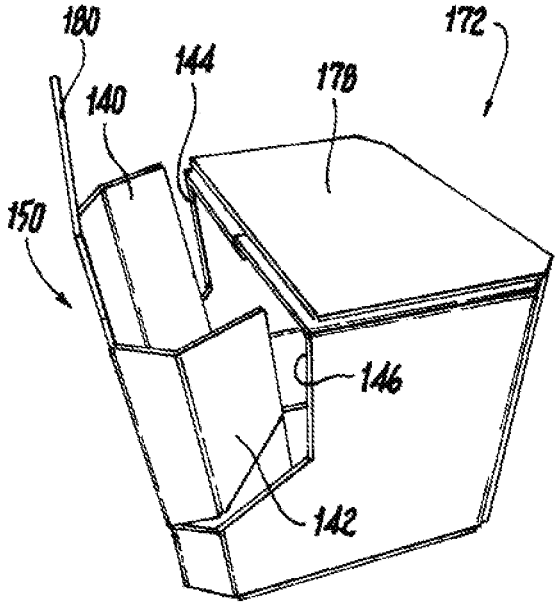
Figure 5:
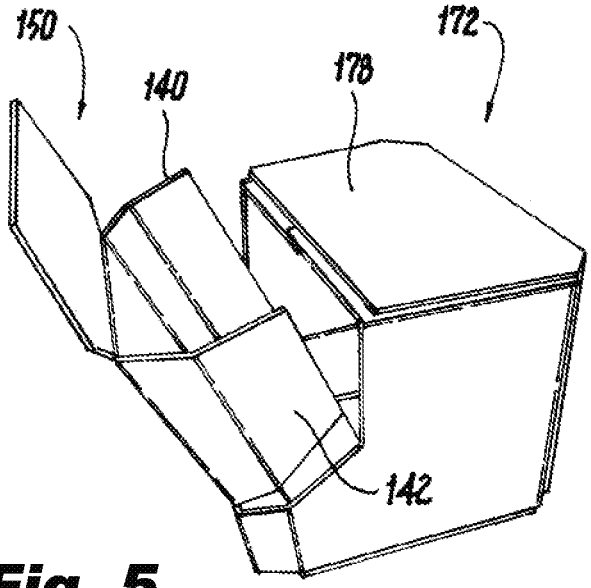
Figure 8:
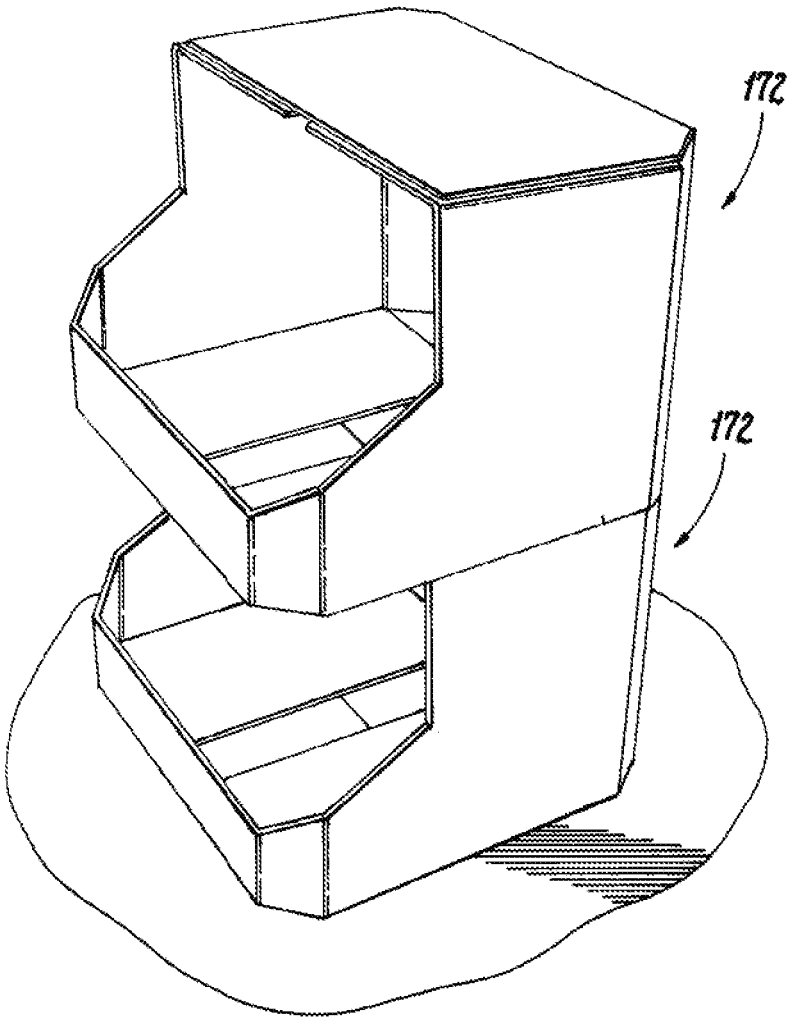
FIG. 8 is a perspective view of two of the converted containers of FIGS. 3-7, showing stacking of two containers.

With reference now to FIG. 4 when it is time for retail display of the product within the container 172, the container 172 can be converted. The conversion is accomplished by removing the insert 150 from a container 172 by removing tear away portions 140, 142 from the container 172. As indicated in FIGS. 5 and 6, the insert 150 and tear away portions 140, 142 are adhered together for removal as one piece from the container 172. The converted container 172 is shown in FIG. 7 without any product therein, however those skilled in the art will readily appreciate that product in the interior space 134 can be both displayed and accessed for removal until the container 172 is empty. As shown in FIG. 8, multiple converted containers 172 can be stacked in the retail configuration.

Figure 9:
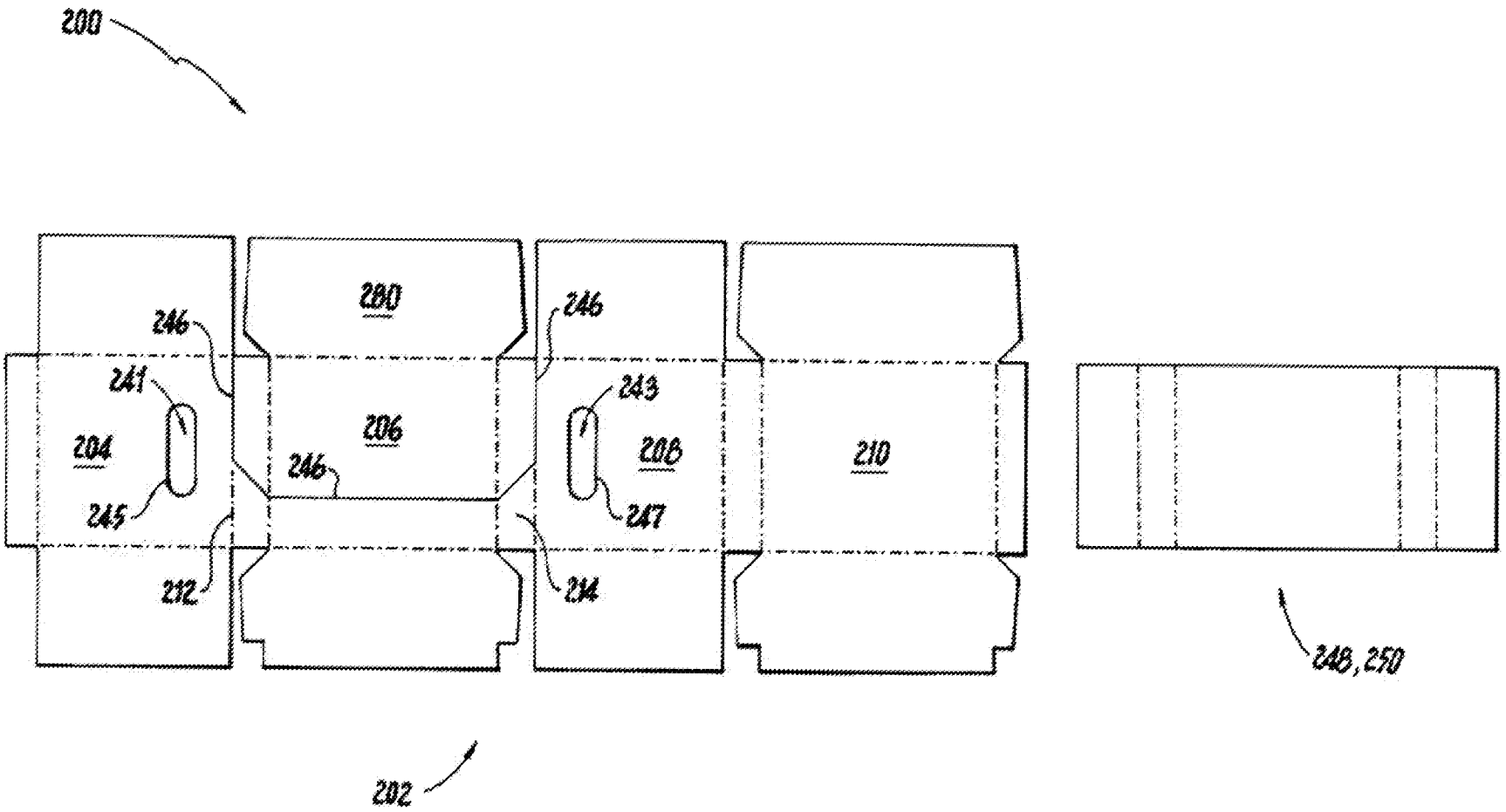
FIG. 9 is a plan view of another embodiment of a blank system constructed in accordance with the present disclosure, showing the main blank and the insert blank.

With reference now to FIG. 9, another embodiment of a blank system 200 is shown, similar to the blank system 100 described above with respect to FIGS. 1-8. In blank system 200, it is the main blank 202 that includes the top panel 280 for a total of four top panels—the insert blank 248 does not have a top panel. The front panel 206 is the same size as the back panel 210 and the line of weakness 246 extends across the full width of the front panel 206. This panel configuration makes it so that when the blank system 200 is formed into a container (using a similar process to that described above with reference to FIG. 2), the insert 250 is positioned inside the interior space. This is in contrast to the blank system 100 described above, wherein the insert 150 forms a part of the exterior of the container 172 cooperating with the plurality of panels 104, 106, 108, 110 to enclose the interior space 134. Also, in the blank system 200, the tear away portions include the upper portion of the front panel 206 (above the line of weakness 246 as oriented in FIG. 9), the upper portions of the corner panels 212, 214 (above the line of weakness 246 as oriented in FIG. 9), and an opposed pair of tear away portions 241, 243 each defining a respective full perimeter line of weakness 245, 247 in one of two opposed side panels 204, 208. The insert 250 can be adhered to any or all of the tear away portions and removal of the insert 250 can leave a window 241, 243 in each of the two opposed side panels 204, 206 (see also the embodiment in FIG. 26). The windows 241, 243 can be defined by lines of weakness 245, 247 to make removal of the insert 250 easier.

Figure 10:
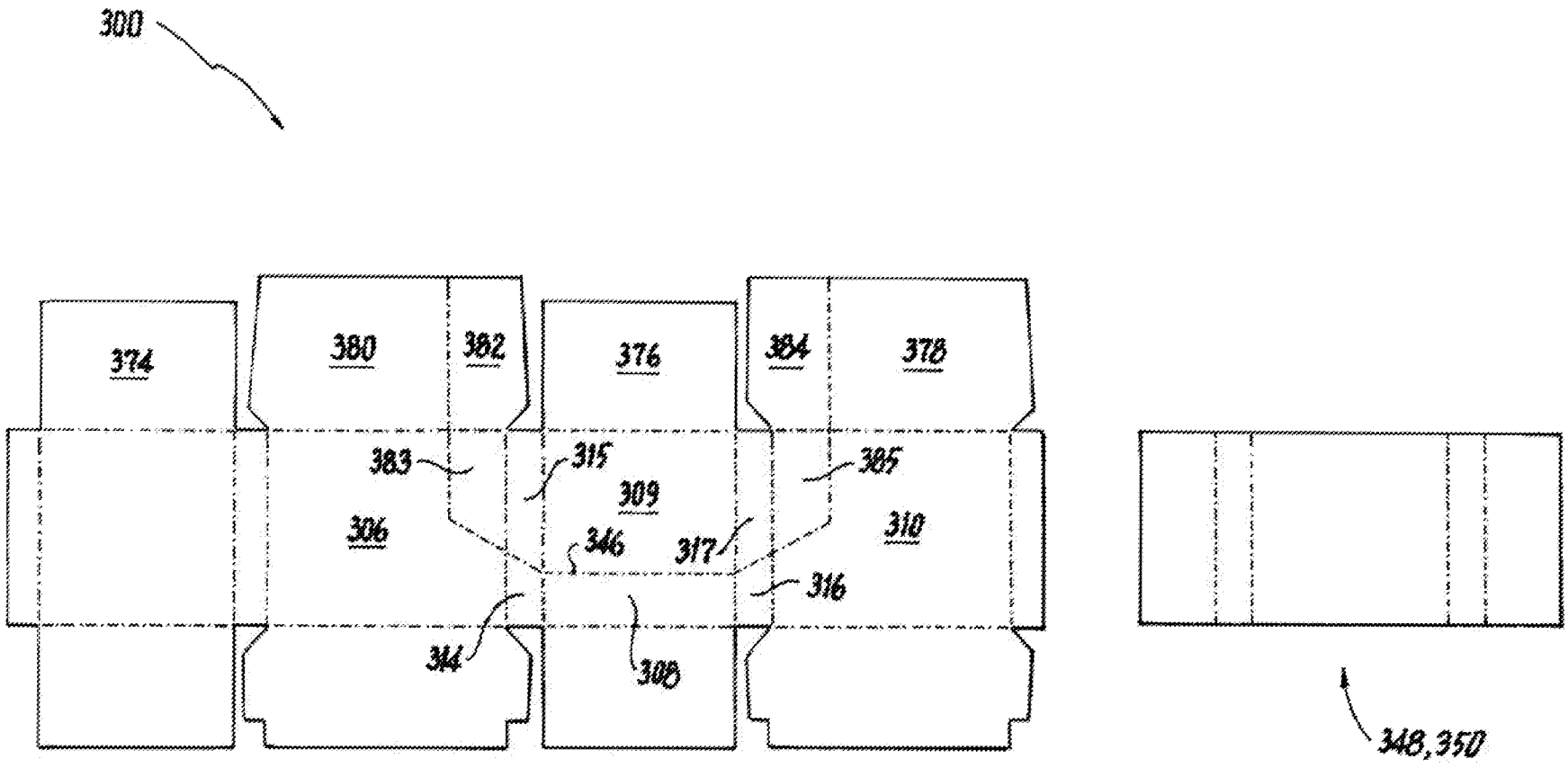
FIG. 10 is a plan view of another embodiment of a blank system constructed in accordance with the present disclosure, showing the main blank and the insert blank.

With reference now to FIG. 10, another embodiment of a blank system 300 is shown, similar to the blank system 200 described above with respect to FIG. 9. In the blank system 300, the tear away portions include the upper portion 309 of the front panel 308 (above the line of weakness 346 as oriented in FIG. 10), the upper flap 376, the upper portions of the corner panels 315, 317 (above the line of weakness 346 as oriented in FIG. 10), an opposed pair of tear away portions 382, 384 which are portions of top panels 380, 378, respectively, and an opposed pair of tear away portions 383, 385, which are portions of panels 306, 310, respectively.

As in the blank systems 100, 200 described above, the blank system 300 the main blank 302 and the insert blank 348 are adhered together, erected, and filled with product. It is also contemplated that the blank system 300 can be adhered together at the first location and shipped in palletized form to the second location for being erected and filled with product. With reference to FIG. 11, the blank system 300 is adhered together and partially erected to form a container 372, (equivalent to stages 6 and 7 of the assembly of the container 172 as depicted in FIG. 2), ready to be filled with product. FIG. 12 depicts the container 372 with the top panels 374, 376, 378, 380, 382, 384 folded into place to enclose an interior space of the container.

Figure 13:
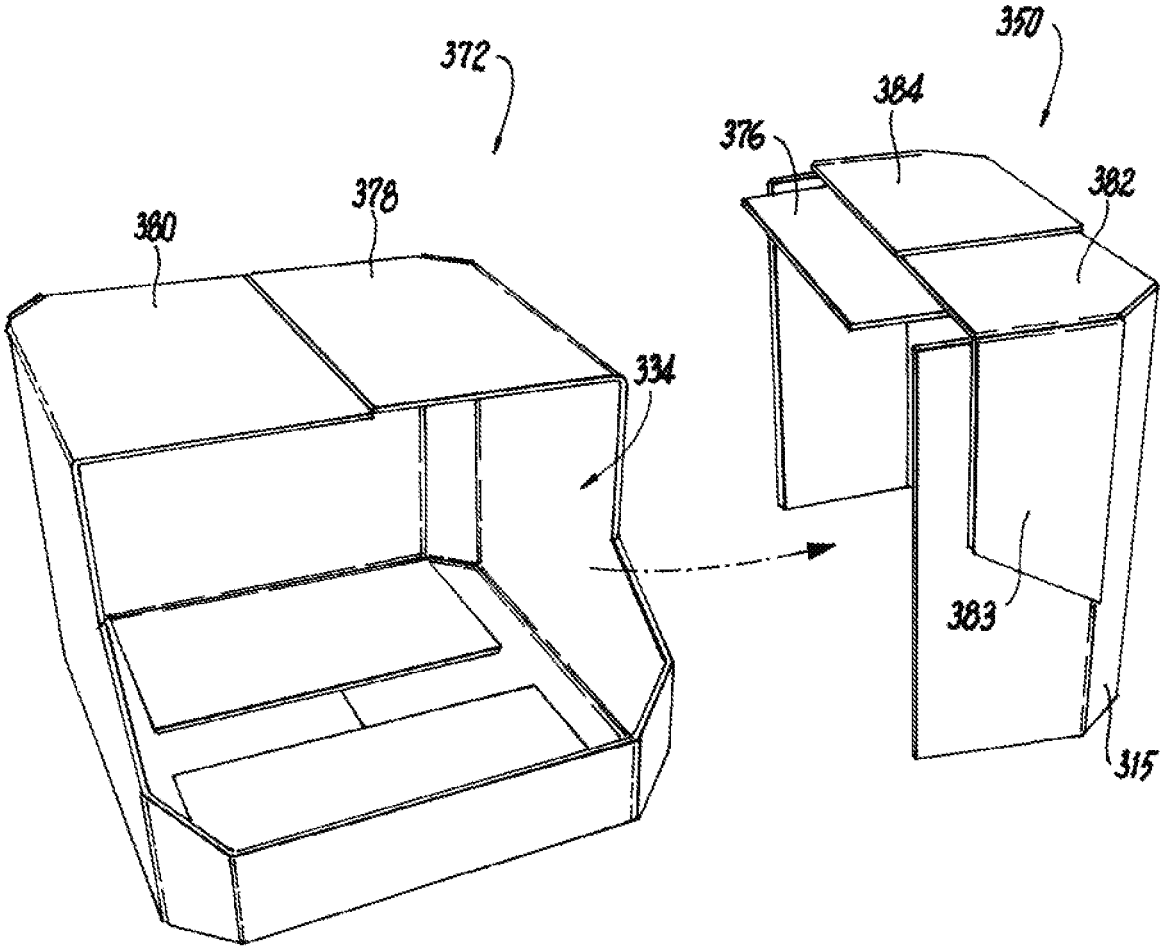

With reference now to FIG. 13, when it is time for retail display of the product within the container 372, the container 372 can be converted, as previously depicted in FIG. 4. The conversion is accomplished by removing the insert 350 from a container 372 by removing tear away portions 309, 315, 317, 376, 382, 383, 384, and 385 from the container 372. FIG. 13 depicts the insert 350 and tear away portions 309, 315, 317, 376, 382, 383, 384, and 385 as being adhered together for removal as one piece from the container 372. The converted container 372 is shown in FIG. 13 without any product therein, however those skilled in the art will readily appreciate that product in the interior space 334 can be both displayed and accessed for removal until the container 372 is empty.

Figure 14:
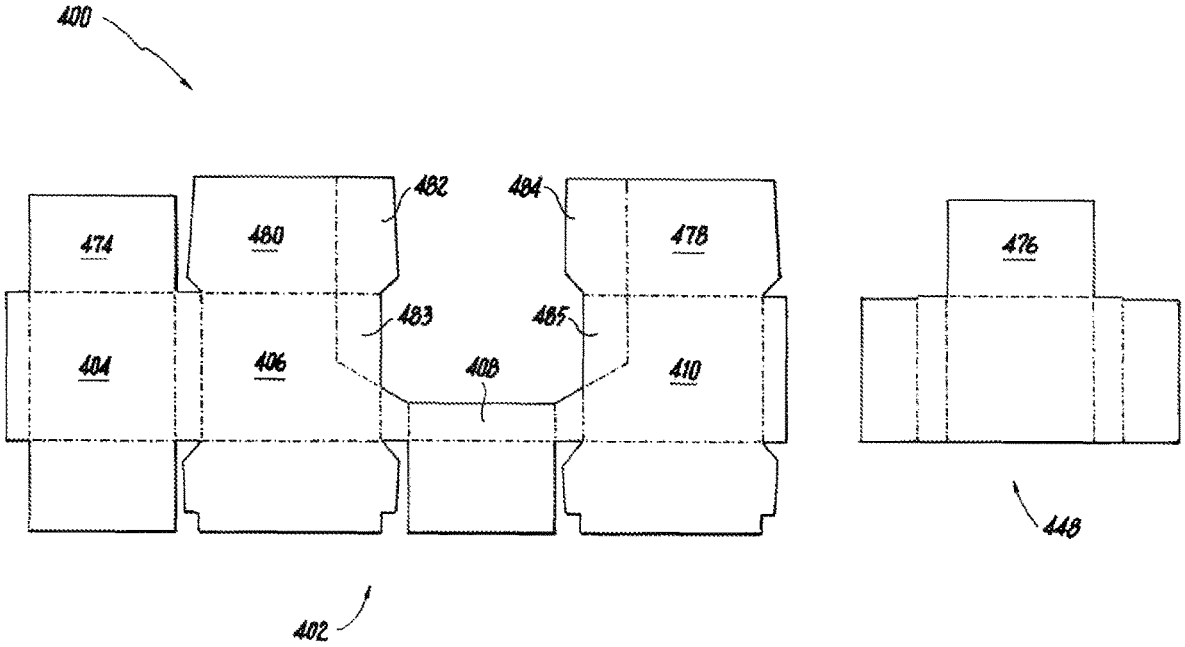
FIGS. 14-18 are plan views of other embodiments of a blank systems constructed in accordance with the present disclosure, each showing the respective main blank and the respective insert blank.

With reference now to FIG. 14, another embodiment of a blank system 400 is shown, similar to the blank system 100 described above with respect to FIG. 1. In blank system 400, the main blank 402 includes top panels 474, 480, 478 and the insert blank 448 has a top panel 476, which is a different top panel than the blank system 100 which has top panel 180 included on the insert blank 148. The front panel 408 is, as in the blank system 100, shorter in height than the back panel 404. This panel configuration makes it so that when the blank system 400 is formed into a container, the insert 450 forms a part of the exterior of the assembled container 472 (similar to FIGS. 3-7), cooperating with the plurality of panels 404, 406, 408, 410 to enclose an interior space 434. In the blank system 400, in contrast to the blank system 100, the tear away portions include an opposed pair of tear away portions 482, 484 which are portions of top panels 480, 478, respectively, and an opposed pair of tear away portions 483, 485, which are portions of panels 406, 410, respectively.

Figure 15:
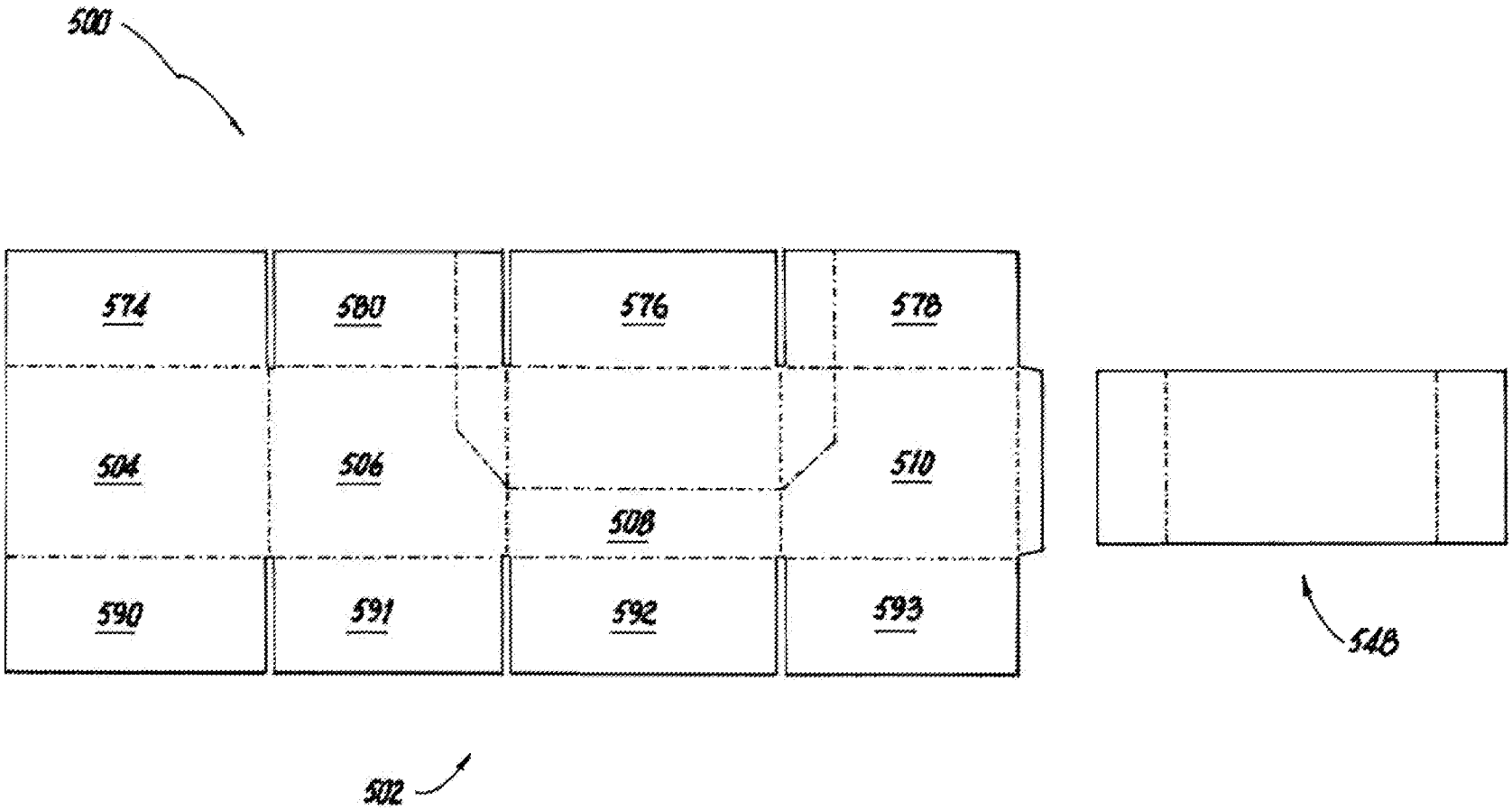

With reference now to FIG. 15, another embodiment of the blank system 500 is shown, similar to the blank system 300 described above with respect to FIG. 10, except that the blank system 500 lacks any corner panels (e.g., 312, 314, 316 as depicted in FIG. 10). Instead, the main blank 502 has four top panels 574, 580, 576, 578, four bottom panels 590, 591, 592, 593 all of which are rectangular in shape, and four main panels 504, 506, 508, 510. The removable portion of the blank system 500 is similar to the blank system 300, excluding the corner panels (315, 317 as depicted in FIG. 10). The insert blank 548 has no top panel. When the blank system 500 is assembled, it adopts a rectangular or square footprint (not shown, but see e.g., FIG. 19) as opposed to the octagonal footprint of the container 172 from the blank system 100.

Figure 16:
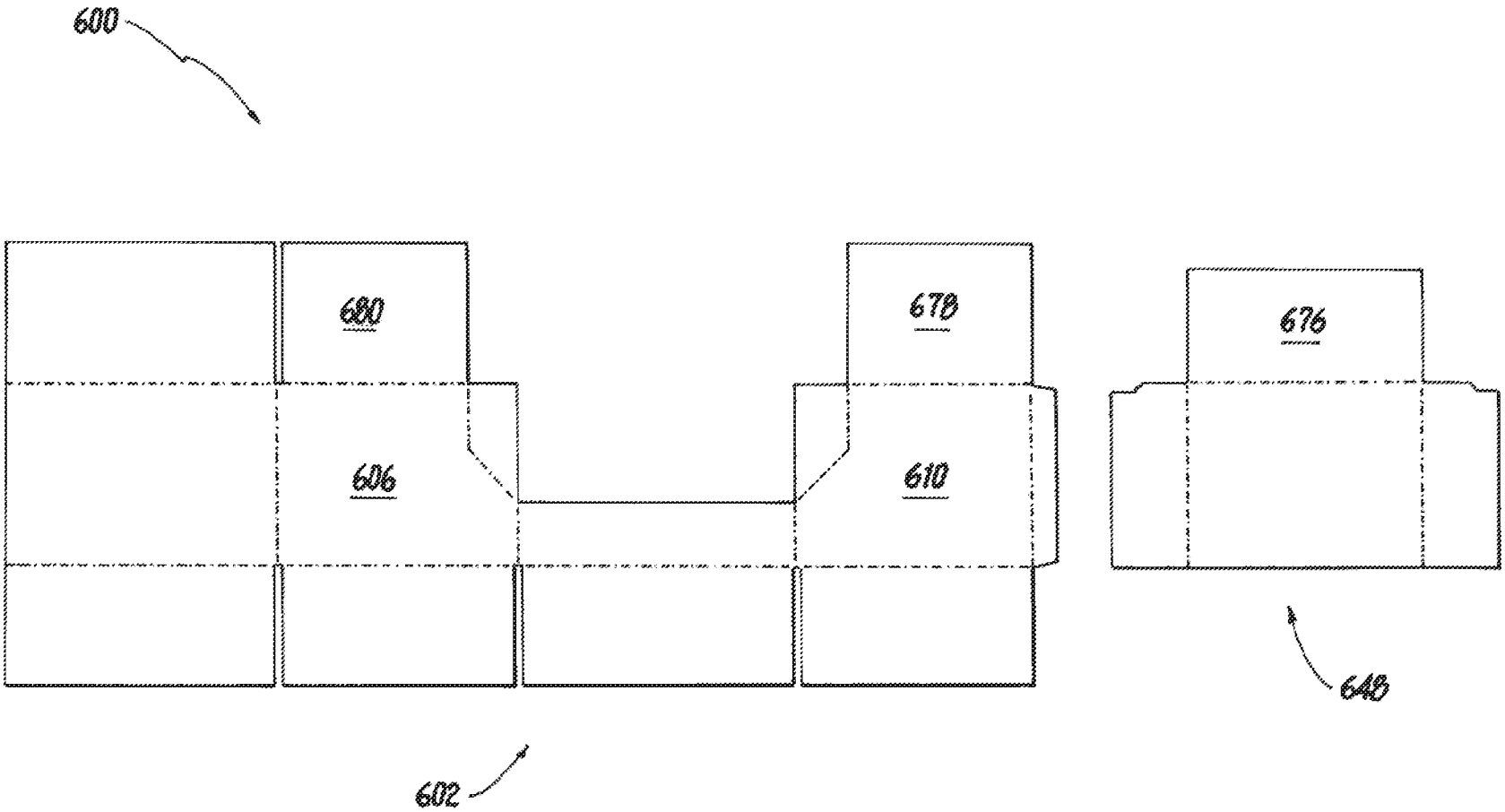

With reference now to FIG. 16, another embodiment of the blank system 600 is shown, similar to the blank system 500 described above with respect to FIG. 15. In the blank system 600, the top panel 676 is not on the main bank 602, but is located on the insert 648. The placement of a top panel 676 on the insert 648 is similar to the blank systems 100 and 400, described above. Additionally, the blank system 600 has top panels 680, 678 that are narrower in width than their counterparts 580, 578 in the blank system 500, e.g., the top panels 680, 678 are narrower than main panels 606, 610.

Figure 17:
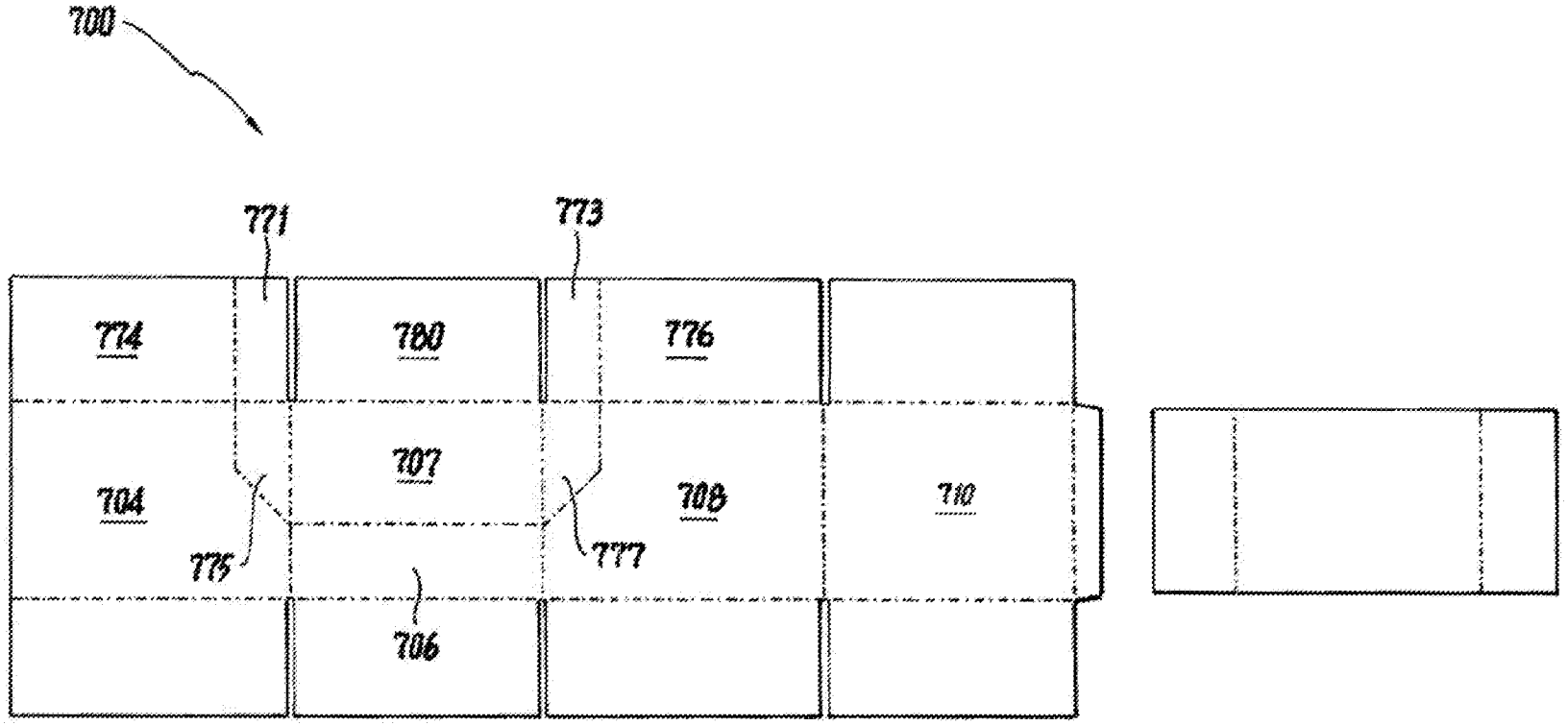

With reference now to FIG. 17, another embodiment of the blank system 700 is shown, similar to the blank system 500 described above with respect to FIG. 15. In the blank system 700, the removable portion of the main blank 702 is shifted one panel to the left as the blank system 700 is oriented in FIG. 17 as compared to the blank system 500 depicted in FIG. 15. The result of shifting the removable portion from one blank system 500, to another blank system 700 is to have the display window formed by removal of the removable portion able to be positioned in either of a length panel (e.g., 508, 504, as depicted in FIG. 15) or an end panel (e.g., 706, 710 as depicted in FIG. 17). The removable portion of the blank system 700 includes a pair of opposed portions 771, 773 of top panels 774, 776, a pair of opposed portions 775, 777 of panels 704, 708, the entirety of top panel 780 and the upper portion 707 (as viewed in FIG. 17) of the panel 706.

Figure 18:
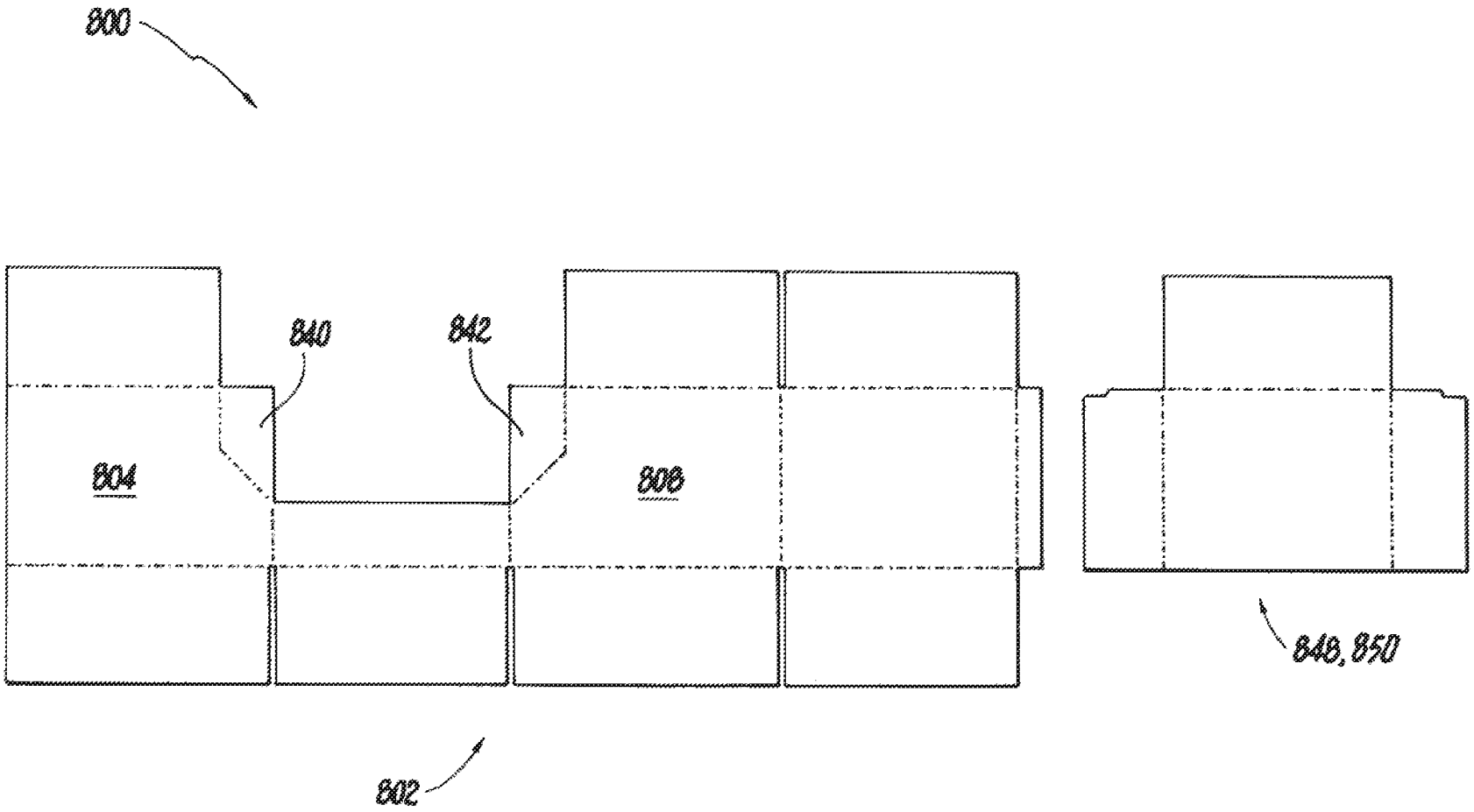
Figure 19:
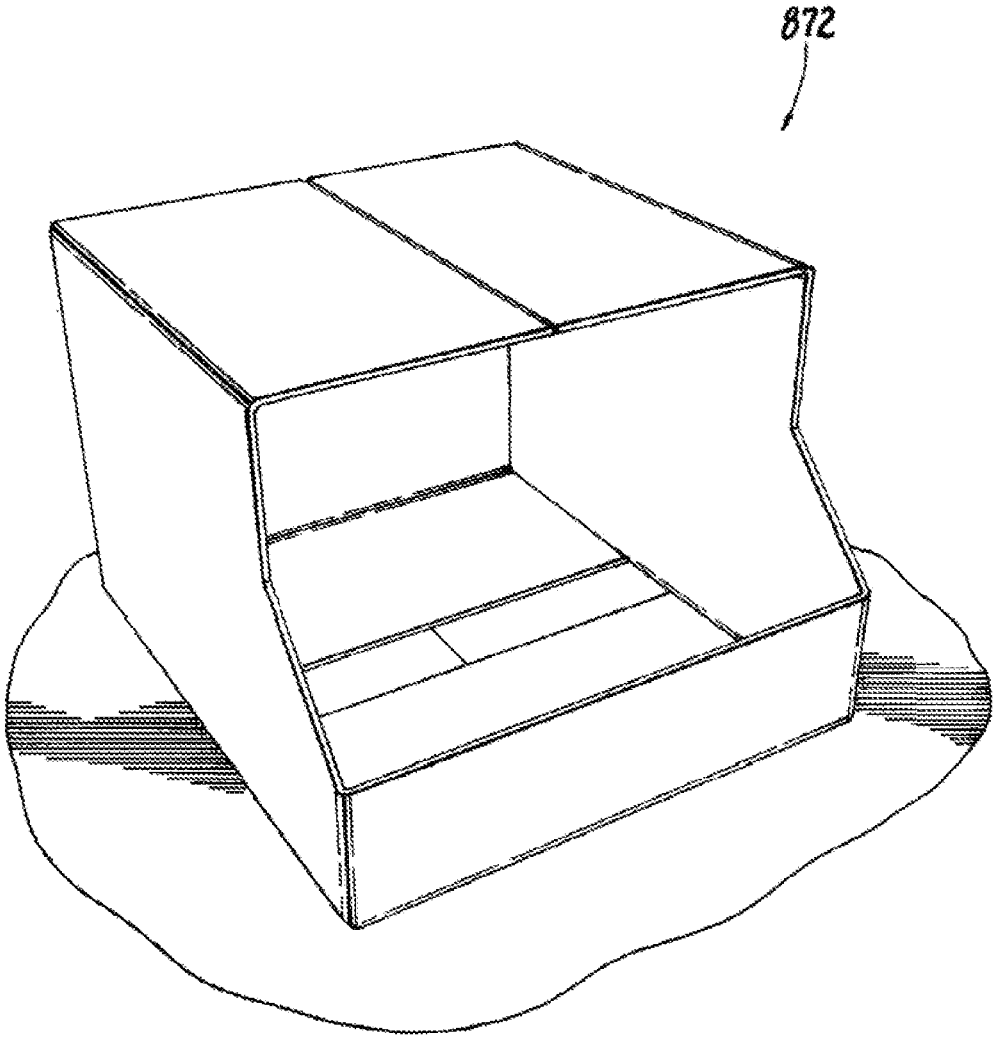
FIG. 19 is a perspective view of a container constructed from the blank system of FIG. 18, showing the container converted for retail display.

With reference now to FIG. 18, another embodiment of the blank system 800 is shown, similar to the blank system 600 described above with respect to FIG. 16. For example, in the blank system 800, the insert blank 848 retains a top panel (e.g., equivalent to the panel labeled in FIG. 16 as 676). In the blank system 800, the removable portion of the main blank 802 is shifted one panel to the left as the blank system 800 is oriented in FIG. 18 as compared to the blank system 600 depicted in FIG. 16. The result of shifting the removable portion from one blank system 600, to another blank system 800 is to have the display window formed by removal of the removable portion able to be positioned in either of a length panel (e.g., 804, 808, as depicted in FIG. 18) or an end panel (e.g., 606, 610, as depicted in FIG. 16) The removable portion of the blank system 800 includes a pair of opposed portions 840, 842 of panels 804, 808. The blank system 800 is shown assembled into a container 872 that encloses an area 834 and has been converted to its retail display format in FIG. 19. The tear away insert 850 is removed from the container in FIG. 19, and is not shown.

Figure 20:
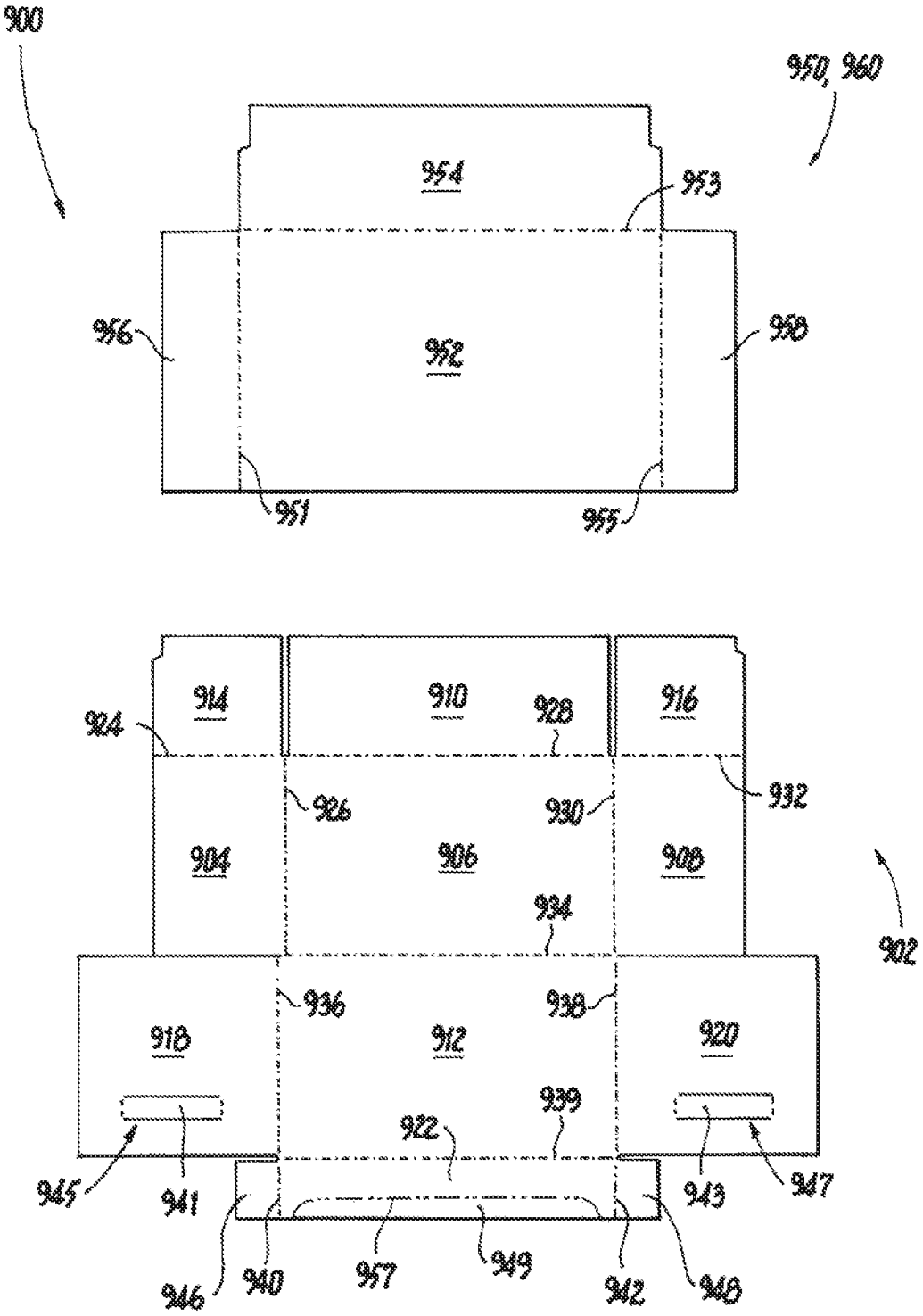
FIG. 20 is a plan view of another embodiment of a blank system constructed in accordance with the present disclosure, showing the main blank and the insert blank.

With reference now to FIG. 20, a blank system 900 is shown. The blank system 900 includes a main blank 902 including a plurality of panels 904, 906, 908, 910, 912 foldably connected together along the fold lines 926, 928, 930, 934. Panels 904 and 908 each include a top flap 914, 916 foldably connected along the fold lines 924, 932. Panel 912 is foldably connected to an opposed pair of side panels 918, 920 along fold lines 936, 938. Panel 912 is also foldably connected to a panel 922 along a fold line 939 opposite the panel 906. The panel 922 is foldably connected to an opposed pair of tabs 946, 948 along fold lines 940, 942. The panel 922 can contain a removable portion 949 defined by a line of weakness 957. Each of the two opposed side panels 918, 920 contains a removable portion 941, 943 defined by lines of weakness 945, 947. The lines of weakness 945, 947, 957 can be microperforations, such that the removable portions 941, 943, 949 are easily removed along their respective lines of weakness 945, 947, 957. When the removable portions 945, 947 are removed, windows are created in the panels 918, 920.

Figure 25:
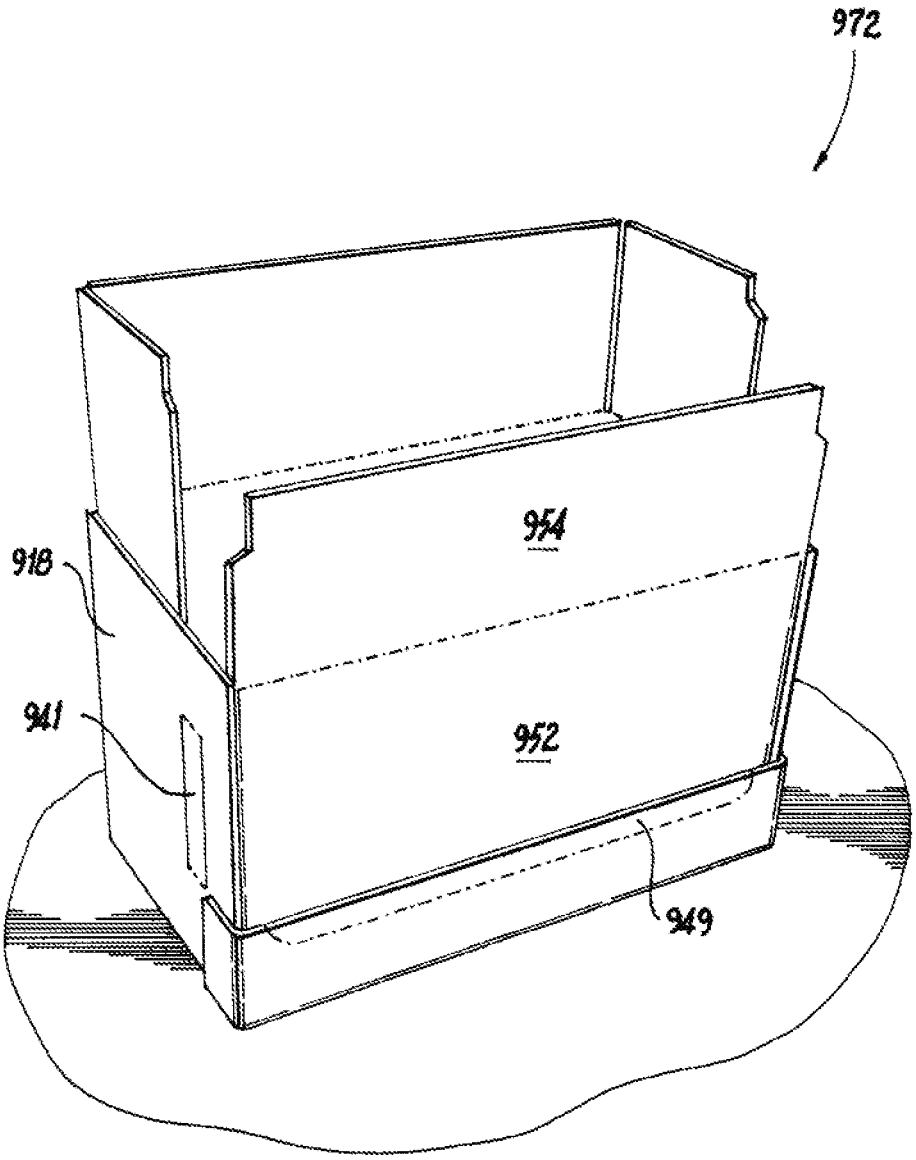

An insert blank 950 is included which is configured to form an insert 960 when the display is folded into a container 972 (as depicted in FIG. 25). The insert blank 950 includes panels 952, 954, 956, 958 foldably connected along the fold lines 951, 953, 955.

Figure 23:
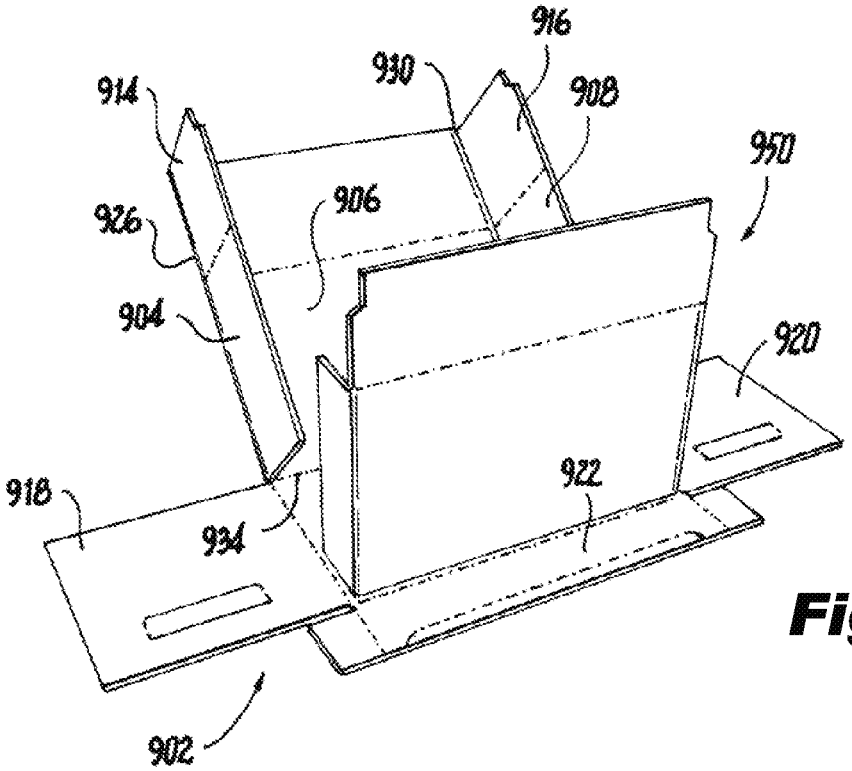
Figure 24:
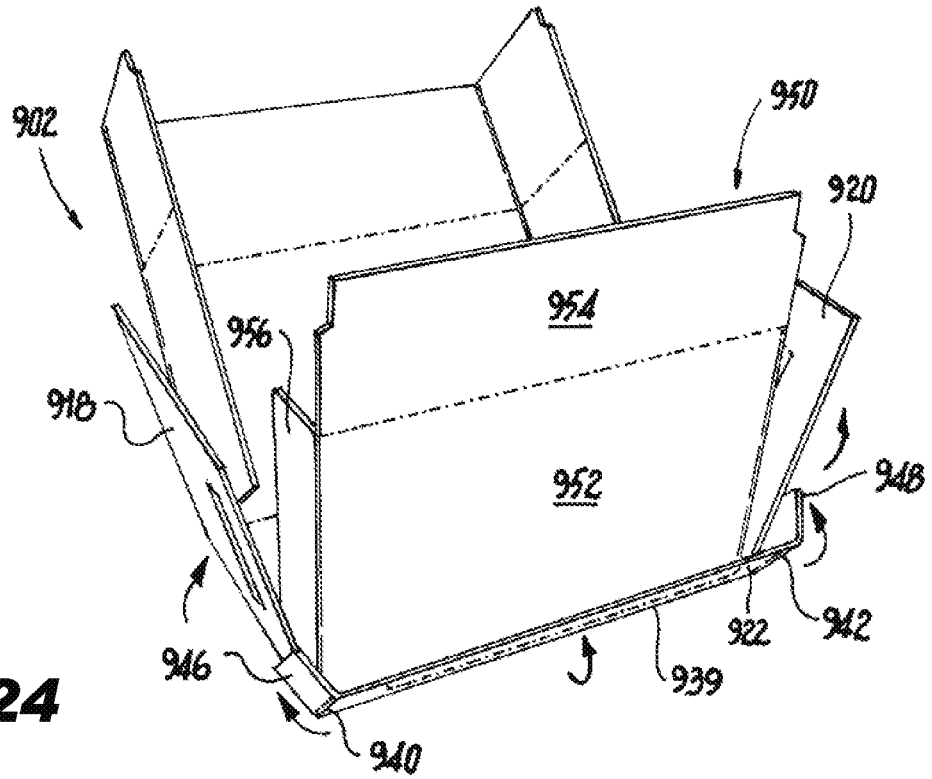

FIGS. 21-26 shows the stepwise folding and assembly of the blanks 902, 950 into a container 972 capable of enclosing goods. In FIGS. 21-22, panels 956, 958 of the insert blank 950, 960 are folded and the insert 960 is placed on the main blank 902, aligning the bottom of the panel 952 along the fold line 939 and the folded panels 956, 958 along fold lines 936, 938. In FIG. 23, the panels 904, 914, 908, 916 are folded along fold lines 926, 930 and panel 906 is folded along fold line 934. In FIG. 24, the side panels 918, 920 are folded upwards along fold lines 936, 938, the tabs 946, 948 connected to the panel 922 are folded along fold lines 940, 942, and the panel 922 is folded upwards along fold line 939. Adhesive can be applied to the removable portions 941, 943 (labeled in FIG. 25) so that they adhere to the panels 956, 958 of the insert 960 during assembly of the container 972. Adhesive can be applied to the removable portion 949 (labeled in FIG. 25) so that it adheres to the panel 952 of the insert 960. The tabs 946, 948 can have adhesive applied to them in order to adhere them to the panels 918, 920 when folded into place to form the container 972. Adhesive can be applied to each of the portions of the panels 918, 920 which interact with the panels 904, 908 when folded into place to form the container 972.

Figure 26:
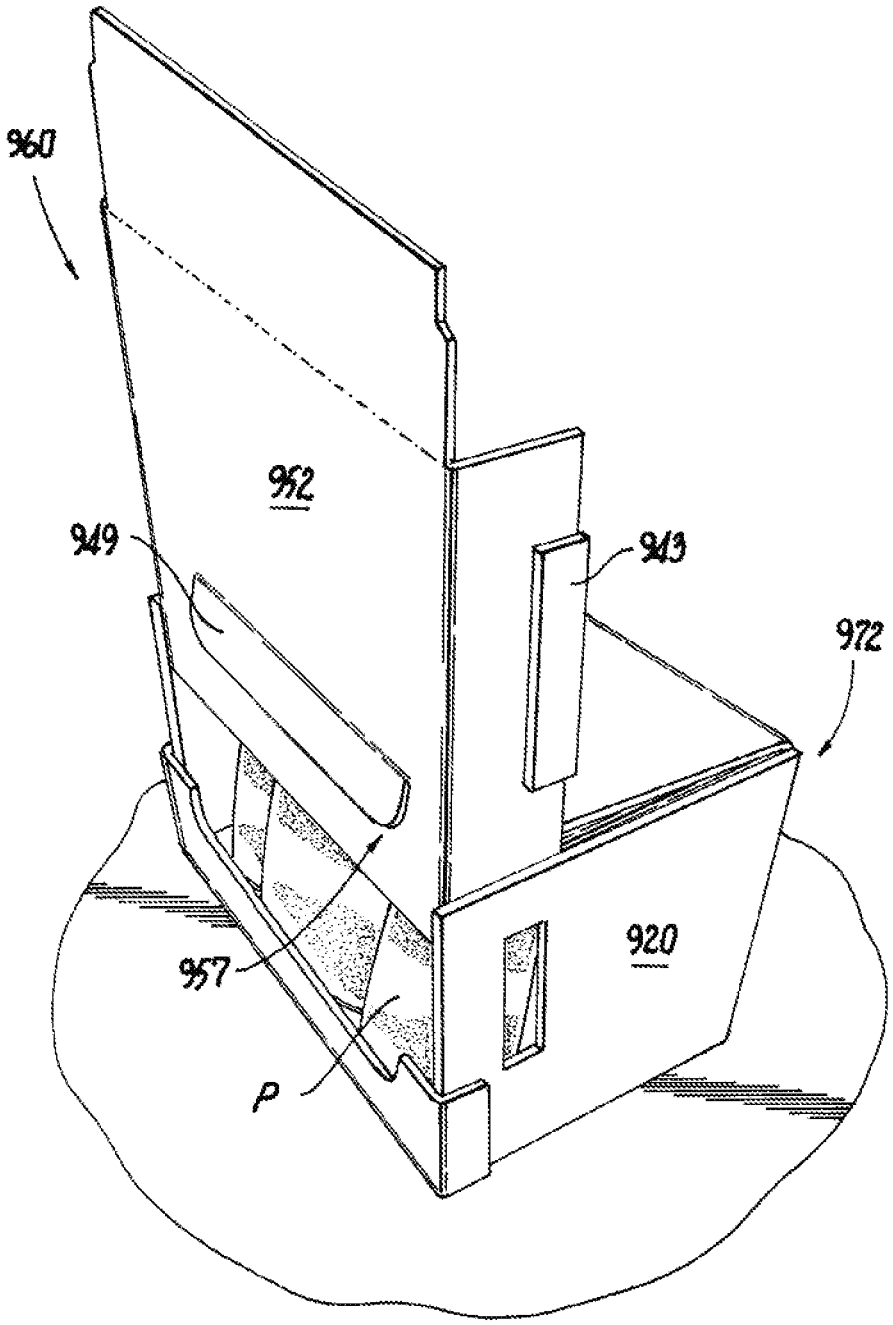
FIG. 26 is a perspective view of the container of FIGS. 21-25, showing the container being converted for retail display.

In FIG. 25, the container 972 is shown in an open configuration such that product may be packed into the container. FIG. 26 demonstrates the conversion of the container 972 into a retail display format by lifting the insert 960 upwards with respect to the container as displayed in FIG. 26 to reveal a stock of product P within the container 972. The removal of the insert 960 is made easier by breaking or punching out the removable portion 943 from the panel 920 creating a window in the panel 920 defined by the line of weakness 947 (labeled in FIG. 20). Visible in FIG. 26 is the removable portion 949 adhered to the panel 952 after being broken or punched out of the panel 922 (labeled in FIG. 20) along the line of weakness 957.

Figure 27:
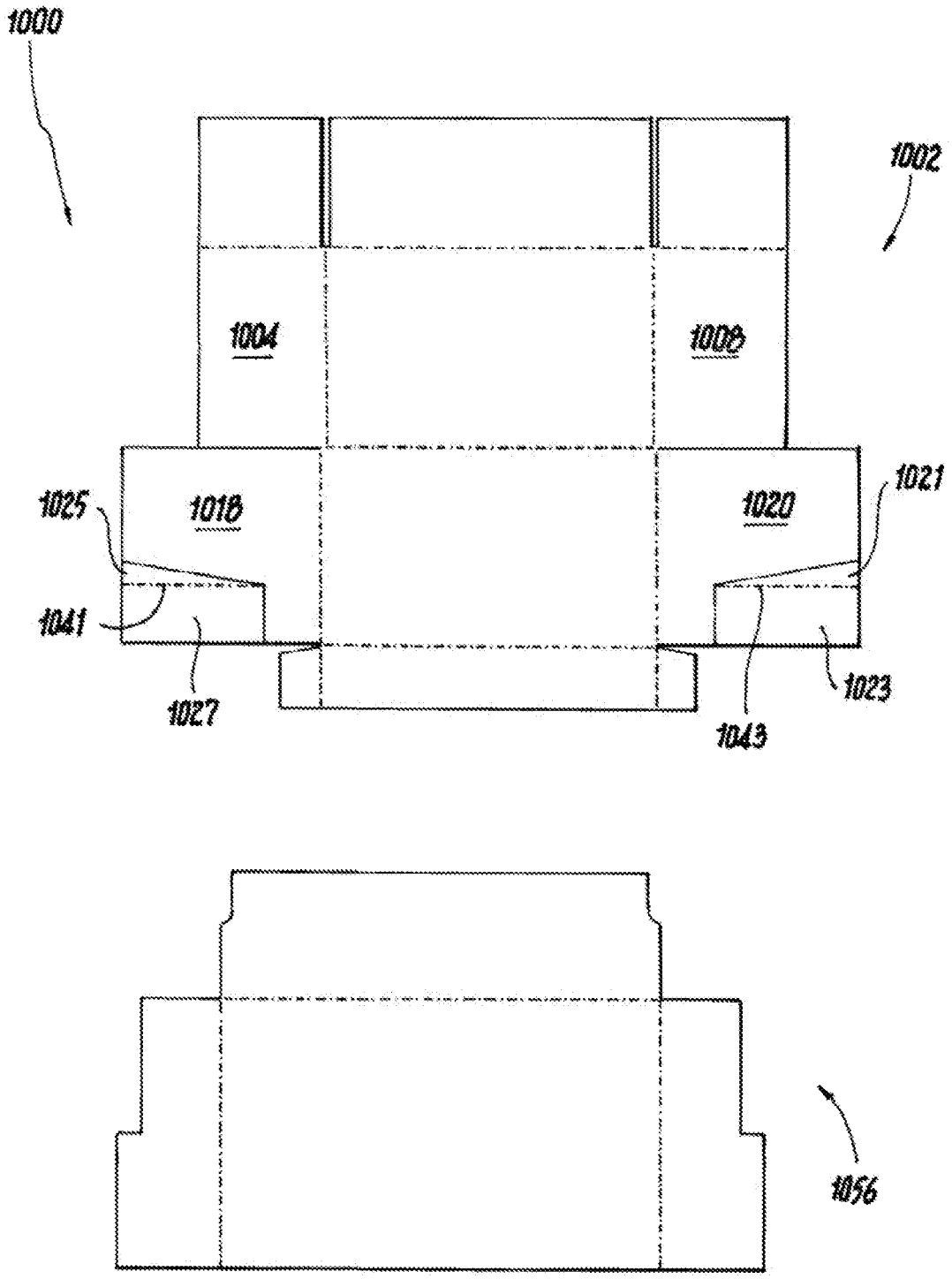
FIG. 27 is a plan view of another embodiment of a blank system constructed in accordance with the present disclosure, showing the main blank and the insert blank.
Figure 28:
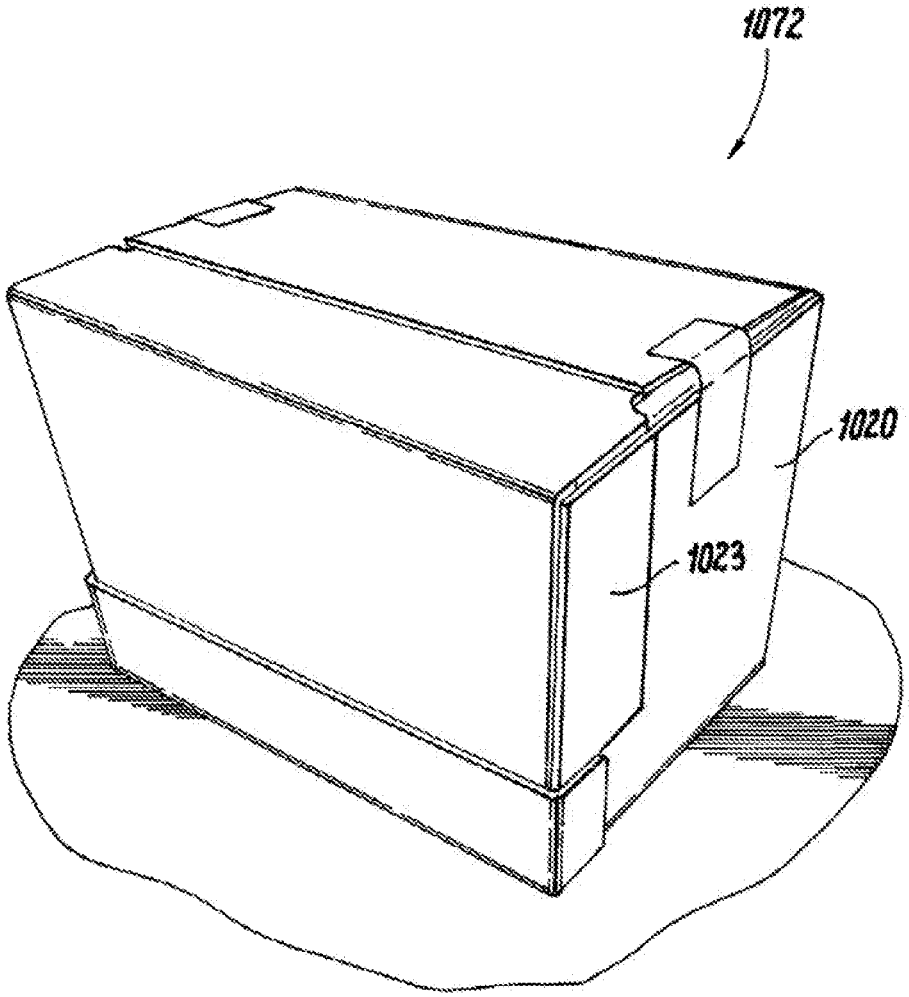
FIG. 28 is a perspective view of a container constructed from the blank system of FIG. 27, showing the container in the closed configuration.

With reference now to FIG. 27, another embodiment of the blank system 1000 is shown. The blank system 1000 is similar to the blank system 900 described above with respect to FIGS. 20-26. In the main blank 1002, the side panels 1018, 1020 each include a respective tear away portions, 1025, 1027, 1021, 1023. Each of the tear away portions can contain a fold line 1041, 1043. In contrast to the blank system 900 described above, any or all of the removable portions 1025, 1027, 1021, 1023 are adhered to the insert 1056 so that the removal of the insert 1056 with the removable portions 1025, 1027, 1021, 1023 can leave a window in each of the two opposed side panels 1018, 1020. FIG. 28 shows the assembled, enclosed container 1072 of the blank system 1000. Visible in FIG. 28 is the tear away portion 1023 of the side panel 1020.

Figure 29:
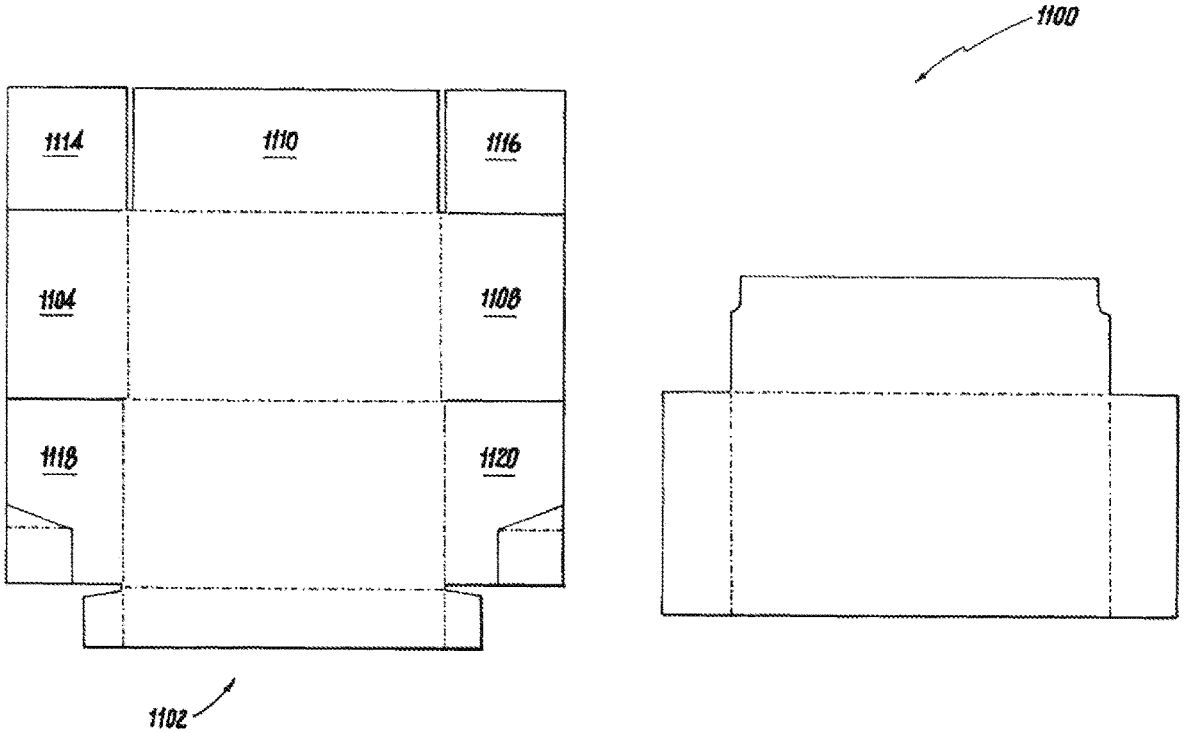
FIG. 29 is a plan view of another embodiment of a blank system constructed in accordance with the present disclosure, showing the main blank and the insert blank.
Figure 30:
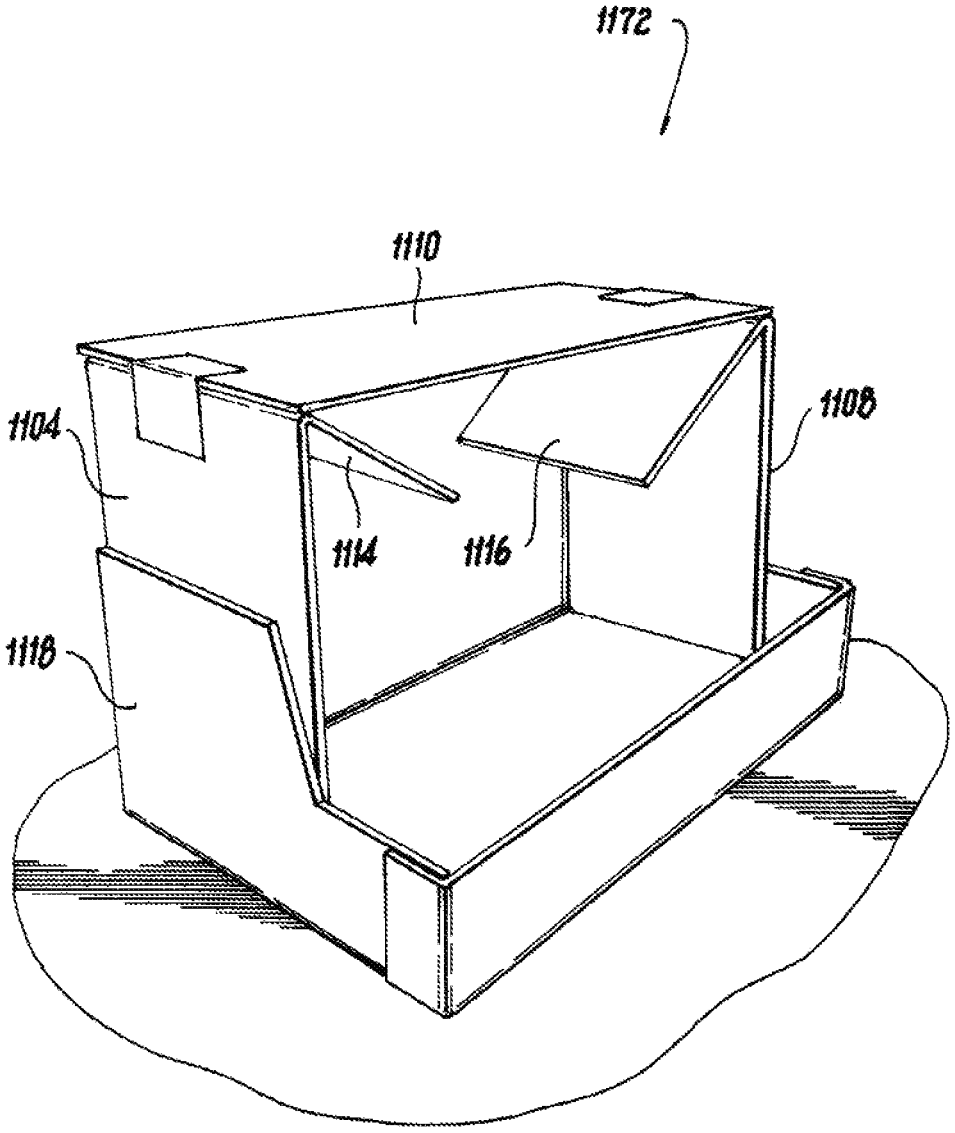
FIG. 30 is a perspective view of a container constructed from the blank system of FIG. 29, showing the container converted for retail display.

With reference now to FIG. 29, another embodiment of the blank system 1100 is shown. The blank system 1100 is similar to the blank system 1000 described above with respect to FIGS. 27-28. The main blank 1102 is partially comprised of a panel 1110 that folds into place to form part of the top of the container 1172 (depicted in FIG. 30). The main blank 1102 has side panels 1118, 1120 that are the same width as panels 1104, 1108, 1114, 1116 in contrast to the blank system 1000 (shown in FIG. 27) where the side panels 1018, 1020 are wider than the panels 1004, 1008. The effect of the uniform width of side panels 1118, 1120 and panels 1104, 1108 is shown in FIG. 30, which depicts the blank system 1100 assembled into a container 1172 that has been converted into a retail display format. The uniform width of side panels 1118, 1120 and panels 1104, 1108 produces a large window for viewing product that may be displayed in the container. Visible in FIG. 30 are panels 1114, 1116 which may be adhered to the panel 1110, or may be prevented from hanging loosely downward as depicted by the presence of product being displayed.

The methods and systems of the present disclosure, as described above and shown in the drawings, provide for retail ready containers with superior properties including load bearing inserts that can be removed during conversion of the container for retail display. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A container comprising:

a plurality of panels connected together to enclose an interior space, said plurality of panels comprising opposed front and rear panels, opposed first and second side panels, and at least one top flap disposed opposite at least one bottom flap, wherein at least one tear away portion is defined in the plurality of panels; and an insert adhered to the at least one tear away portion for removal from the plurality of panels together with the at least one tear away portion to provide access to the interior space;

wherein the insert extends from a first end of the interior space to an opposite end of the interior space as a load bearing member between two opposed panels of the plurality of panels;

wherein the at least one tear away portion includes an opposed pair of tear away portions each defining a full perimeter in a respective one of the first and second side panels such that removal of the insert leaves a window in each of the first and second side panels;

wherein the insert includes a main insert panel, a first side flap connected to the main insert panel along a first fold line, and a second side flap connected to the main insert panel along a second fold line opposite the first fold line;

wherein the first side flap of the insert is disposed in face-contacting relationship with the first side panel, the second side flap of the insert is disposed in face-contacting relationship with the second side panel, and at least a portion of the main insert panel is disposed in face-contacting relationship with the front panel;

wherein the insert is adhered to the first and second tear away portions.

2. The container as recited in claim 1, wherein the insert defines a load bearing path from the first end of the interior space to the second end of the interior space, wherein the load bearing path is free of lines of weakness.

3. The container as recited in claim 2, wherein the insert includes corrugated paper material with corrugations aligned along a corrugation direction, wherein the load bearing path extends in the corrugation direction.

4. The container as recited in claim 1, wherein the insert is positioned inside the interior space.

5. The container as recited in claim 1, wherein the insert forms at least part of an exterior cooperating with the plurality of panels to enclose the interior space.

6. The container as recited in claim 1, wherein the at least one tear away portion is defined in the plurality of panels by at least one respective line of weakness in the plurality of panels.

7. The container as recited in claim 1, wherein the at least one tear away portion includes a front tear away portion in front panel.

8. A container comprising:

a plurality of panels connected together to enclose an interior space, said plurality of panels comprising opposed front and rear panels, opposed first and second side panels, and at least one top flap disposed opposite at least one bottom flap, wherein at least one tear away portion is defined in the plurality of panels; and an insert adhered to the at least one tear away portion for removal from the plurality of panels together with the at least one tear away portion to provide access to the interior space;

wherein the insert extends from a first end of the interior space to an opposite end of the interior space as a load bearing member between two opposed panels of the plurality of panels;

wherein the at least one tear away portion includes an opposed pair of tear away portions each defining a full perimeter in a respective one of the first and second side panels such that removal of the insert leaves a window in each of the first and second side panels;

wherein the insert includes a main insert panel, a first side flap connected to the main insert panel along a first fold line, and a second side flap connected to the main insert panel along a second fold line opposite the first fold line;

wherein the first side flap of the insert is disposed in face-contacting relationship with the first side panel, the second side flap of the insert is disposed in face-contacting relationship with the second side panel, and at least a portion of the main insert panel is disposed in face-contacting relationship with the front panel;

wherein the insert includes a top flap connected to the main insert panel along a top fold line extending in a direction from the first fold line to the second fold line.

9. A blank system for forming a container comprising:

a main blank including a plurality of panels foldably connected together for enclosing an interior space, said plurality of panels comprising front and rear panels configured to form opposed front and rear walls in a set-up container, first and second side panels configured to form opposed side walls in the set-up container, at least one top flap configured to form at least part of a top wall in the set-up container, and at least one bottom flap configured to form at least part of a bottom wall in the set-up container, said bottom wall being disposed opposite said top wall, wherein at least one tear away portion is defined in the plurality of panels; and an insert blank configured to form an insert adhered to the at least one tear away portion for removal from the plurality of panels together with the at least one tear away portion to provide access to the interior space;

wherein the insert is configured to extend from a first end of the interior space to an opposite end of the interior space as a load bearing member between two opposed panels of the plurality of panels;

wherein the at least one tear away portion includes an opposed pair of tear away portions each defining a full perimeter in a respective one of the first and second side panels such that removal of the insert leaves a window in each of the first and second side panels;

wherein the insert includes a main insert panel, a first side flap connected to the main insert panel along a first fold line, and a second side flap connected to the main insert panel along a second fold line opposite the first fold line;

wherein the first side flap of the insert is configured to be disposed in face-contacting relationship with the first side panel in the set-up container, the second side flap of the insert is configured to be disposed in face-contacting relationship with the second side panel in the set-up container, and at least a portion of the main insert panel is disposed in face-contacting relationship with the front panel in the set-up container;

wherein the insert includes a top flap connected to the main insert panel along a top fold line extending in a direction from the first fold line to the second fold line.

10. The system as recited in claim 9, wherein the main blank and the insert blank are adhered together.

11. The system as recited in claim 9, wherein the insert defines a load bearing path configured to extend from the first end of the interior space to the second end of the interior space, wherein the load bearing path is free of lines of weakness.

12. The system as recited in claim 11, wherein the insert includes corrugated paper material with corrugations aligned along a corrugation direction, wherein the load bearing path extends in the corrugation direction.

13. The system as recited in claim 9, wherein the insert is configured to form at least part of an exterior cooperating with the plurality of panels to enclose the interior space.

14. The system as recited in claim 9, wherein the at least one tear away portion is defined in the plurality of panels by at least one respective line of weakness in the plurality of panels.

15. The system as recited in claim 9, wherein the at least one tear away portion includes a front tear away portion in front panel.

* * * * *